US009010442B2

(12) United States Patent
Streich et al.

(10) Patent No.: US 9,010,442 B2
(45) Date of Patent: Apr. 21, 2015

(54) METHOD OF COMPLETING A MULTI-ZONE FRACTURE STIMULATION TREATMENT OF A WELLBORE

(71) Applicant: Halliburton Energy Services, Inc., Houston, TX (US)

(72) Inventors: Steven G. Streich, Duncan, OK (US); Zachary William Walton, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 333 days.

(21) Appl. No.: 13/624,173

(22) Filed: Sep. 21, 2012

(65) Prior Publication Data

US 2014/0083689 A1 Mar. 27, 2014

(51) Int. Cl.

| | |
|---|---|
| ***E21B 34/08*** | (2006.01) |
| ***E21B 34/06*** | (2006.01) |
| ***E21B 34/10*** | (2006.01) |
| *E21B 34/00* | (2006.01) |

(52) U.S. Cl.

CPC ..... *E21B 34/063* (2013.01); *E21B 34/10* (2013.01); *E21B 34/102* (2013.01); *E21B 2034/005* (2013.01); *E21B 2034/007* (2013.01)

(58) Field of Classification Search

USPC ..... 166/306, 374, 376, 386, 317, 332.8, 166/66.7

See application file for complete search history.

(56) References Cited

U.S. PATENT DOCUMENTS

| | | | |
|---|---|---|---|
| 2,189,936 | A | 2/1940 | Brandfon |
| 2,189,937 | A | 2/1940 | Broyles |
| 2,308,004 | A | 1/1943 | Hart |
| 2,330,265 | A | 9/1943 | Burt |
| 2,373,006 | A | 4/1945 | Baker |

(Continued)

FOREIGN PATENT DOCUMENTS

| | | |
|---|---|---|
| EP | 2467575 | 2/2011 |
| WO | 2007008351 A1 | 1/2007 |

(Continued)

OTHER PUBLICATIONS

Foreign communication from a related counterpart application—International Preliminary Report on Patentability, PCT/US2010/061047, Jul. 17, 2012, 5 pages.

Foreign communication from a related counterpart application—International Search Report and Written Opinion, PCT/US2010/061047, Jun. 23, 2011, 9 pages.

Foreign communication from a related counterpart application—International Preliminary Report on Patentability, PCT/US2006/023947, Jan. 24, 2008, 6 pages.

(Continued)

*Primary Examiner* — Cathleen Hutchins

(74) *Attorney, Agent, or Firm* — John W. Wustenberg; Baker Botts L.L.P.

(57) ABSTRACT

A wellbore servicing tool comprising a housing comprising ports, a triggering system, a first sliding sleeve transitional from a first position to a second position, and a second sliding sleeve transitional from a first position to a second position, wherein, when in the first position, the first sliding sleeve retains the second sliding sleeve in the first position, wherein, when in the first position, the second sliding sleeve prevents a route of fluid communication via the one or more ports of the housing and, when is in the second position, the second sliding sleeve allows fluid communication via the ports, and wherein the triggering system is configured to allow the first sliding sleeve to transition from the first position to the second position responsive to recognition of a predetermined signal comprising a predetermined pressure signal, a predetermined temperature signal, a predetermined flow-rate signal, or combinations thereof.

25 Claims, 14 Drawing Sheets

(56) References Cited

U.S. PATENT DOCUMENTS

| | | | |
|---|---|---|---|
| 2,381,929 | A | 8/1945 | Schlumberger |
| 2,618,343 | A | 11/1952 | Conrad |
| 2,637,402 | A | 5/1953 | Baker et al. |
| 2,640,547 | A | 6/1953 | Baker et al. |
| 2,695,064 | A | 11/1954 | Ragan et al. |
| 2,974,727 | A | 3/1961 | Goodwin |
| 3,029,873 | A | 4/1962 | Hanes |
| 3,055,430 | A | 9/1962 | Campbell |
| 3,122,728 | A | 2/1964 | Lindberg, Jr. |
| 3,160,209 | A | 12/1964 | Bonner |
| RE25,846 | E | 8/1965 | Campbell |
| 3,233,674 | A | 2/1966 | Leutwyler |
| 3,266,575 | A | 8/1966 | Owen |
| 3,398,803 | A | 8/1968 | Leutwyler et al. |
| 3,665,955 | A | 5/1972 | Conner, Sr. |
| 4,085,590 | A | 4/1978 | Powell et al. |
| 4,282,931 | A | 8/1981 | Golben |
| 4,352,397 | A | 10/1982 | Christopher |
| 4,377,209 | A | 3/1983 | Golben |
| 4,385,494 | A | 5/1983 | Golben |
| 4,402,187 | A | 9/1983 | Golben et al. |
| 4,421,174 | A | 12/1983 | McStravick et al. |
| 4,598,769 | A | 7/1986 | Robertson |
| 4,796,699 | A | 1/1989 | Upchurch |
| 4,856,595 | A | 8/1989 | Upchurch |
| 4,884,953 | A | 12/1989 | Golben |
| 5,024,270 | A | 6/1991 | Bostick |
| 5,056,600 | A | 10/1991 | Surjaatmadja et al. |
| 5,074,940 | A | 12/1991 | Ochi et al. |
| 5,101,907 | A | 4/1992 | Schultz et al. |
| 5,197,758 | A | 3/1993 | Lund et al. |
| 5,211,224 | A | 5/1993 | Bouldin |
| 5,238,070 | A | 8/1993 | Schultz et al. |
| 5,299,640 | A | 4/1994 | Streich et al. |
| 5,314,015 | A | 5/1994 | Streich et al. |
| 5,316,081 | A | 5/1994 | Baski et al. |
| 5,316,087 | A | 5/1994 | Manke et al. |
| 5,343,963 | A | 9/1994 | Bouldin et al. |
| 5,355,960 | A | 10/1994 | Schultz et al. |
| 5,379,835 | A | 1/1995 | Streich |
| 5,396,951 | A | 3/1995 | Ross |
| 5,452,763 | A | 9/1995 | Owen |
| 5,485,884 | A | 1/1996 | Hanley et al. |
| 5,490,564 | A | 2/1996 | Schultz et al. |
| 5,531,845 | A | 7/1996 | Flanigan et al. |
| 5,533,570 | A | 7/1996 | Streich et al. |
| 5,573,307 | A | 11/1996 | Wilkinson et al. |
| 5,597,042 | A | 1/1997 | Tubel et al. |
| 5,673,556 | A | 10/1997 | Goldben et al. |
| 5,687,791 | A | 11/1997 | Beck et al. |
| 5,700,974 | A | 12/1997 | Taylor |
| 5,718,287 | A | 2/1998 | Streich et al. |
| 5,732,776 | A | 3/1998 | Tubel et al. |
| 5,758,726 | A | 6/1998 | Streich et al. |
| 5,995,449 | A | 11/1999 | Green et al. |
| 6,021,095 | A | 2/2000 | Tubel et al. |
| 6,041,864 | A | 3/2000 | Patel et al. |
| 6,095,247 | A | 8/2000 | Streich et al. |
| 6,128,904 | A | 10/2000 | Rosso, Jr. et al. |
| 6,142,226 | A | 11/2000 | Vick |
| 6,172,614 | B1 | 1/2001 | Robison et al. |
| 6,186,226 | B1 | 2/2001 | Robertson |
| 6,305,467 | B1 | 10/2001 | Connell et al. |
| 6,310,829 | B1 | 10/2001 | Green et al. |
| 6,315,043 | B1 | 11/2001 | Farrant et al. |
| 6,349,772 | B2 | 2/2002 | Mullen et al. |
| 6,378,611 | B1 | 4/2002 | Helderle |
| 6,384,738 | B1 | 5/2002 | Carstensen et al. |
| 6,388,577 | B1 | 5/2002 | Carstensen |
| 6,397,950 | B1 | 6/2002 | Streich et al. |
| 6,414,905 | B1 | 7/2002 | Owens et al. |
| 6,438,070 | B1 | 8/2002 | Birchak et al. |
| 6,450,258 | B2 | 9/2002 | Green et al. |
| 6,561,479 | B1 | 5/2003 | Eldridge |
| 6,568,470 | B2 | 5/2003 | Goodson, Jr. et al. |
| 6,598,679 | B2 | 7/2003 | Robertson |
| 6,601,646 | B2 | 8/2003 | Streich et al. |
| 6,651,747 | B2 | 11/2003 | Chen et al. |
| 6,695,061 | B2 | 2/2004 | Fripp et al. |
| 6,705,425 | B2 | 3/2004 | West |
| 6,710,720 | B2 | 3/2004 | Carstensen et al. |
| 6,760,275 | B2 | 7/2004 | Carstensen |
| 6,776,255 | B2 | 8/2004 | West et al. |
| 6,925,937 | B2 | 8/2005 | Robertson |
| 6,926,086 | B2 | 8/2005 | Patterson et al. |
| 6,945,331 | B2 | 9/2005 | Patel |
| 6,971,449 | B1 | 12/2005 | Robertson |
| 6,973,993 | B2 | 12/2005 | West et al. |
| 7,044,230 | B2 | 5/2006 | Starr et al. |
| 7,083,009 | B2 | 8/2006 | Paluch et al. |
| 7,108,073 | B2 | 9/2006 | Patel |
| 7,152,679 | B2 | 12/2006 | Simpson |
| 7,171,309 | B2 | 1/2007 | Goodman |
| 7,191,672 | B2 | 3/2007 | Ringgenberg et al. |
| 7,197,923 | B1 | 4/2007 | Wright et al. |
| 7,234,517 | B2 | 6/2007 | Streich et al. |
| 7,237,616 | B2 | 7/2007 | Patel |
| 7,252,152 | B2 | 8/2007 | LoGiudice et al. |
| 7,295,491 | B2 | 11/2007 | Carstensen |
| 7,395,882 | B2 | 7/2008 | Oldham et al. |
| 7,398,996 | B2 | 7/2008 | Saito et al. |
| 7,431,335 | B2 | 10/2008 | Khandhadia et al. |
| 7,503,398 | B2 | 3/2009 | LoGiudice et al. |
| 7,597,151 | B2 | 10/2009 | Curtis et al. |
| 7,604,062 | B2 | 10/2009 | Murray |
| 7,614,454 | B2 | 11/2009 | Buyers et al. |
| 7,802,627 | B2 | 9/2010 | Hofman et al. |
| 7,832,474 | B2 | 11/2010 | Nguy |
| 7,866,408 | B2 | 1/2011 | Allison et al. |
| 7,946,166 | B2 | 5/2011 | Irani et al. |
| 8,136,594 | B2 | 3/2012 | Streich et al. |
| 8,169,854 | B2 | 5/2012 | Godager |
| 8,191,629 | B2 | 6/2012 | Gordon et al. |
| 8,258,975 | B2 | 9/2012 | Tinnen et al. |
| 2005/0260468 | A1 | 11/2005 | Fripp et al. |
| 2006/0124312 | A1* | 6/2006 | Rytlewski et al. ..... 166/313 |
| 2007/0089911 | A1 | 4/2007 | Moyes |
| 2007/0277979 | A1* | 12/2007 | Todd et al. ..... 166/287 |
| 2008/0128130 | A1* | 6/2008 | Whitsitt et al. ..... 166/278 |
| 2009/0044937 | A1 | 2/2009 | Purkis |
| 2009/0067288 | A1 | 3/2009 | Godager |
| 2010/0084060 | A1 | 4/2010 | Hinshaw et al. |
| 2010/0200244 | A1 | 8/2010 | Purkis |
| 2011/0267194 | A1 | 11/2011 | Hong et al. |
| 2012/0037360 | A1* | 2/2012 | Arizmendi et al. ..... 166/250.01 |
| 2012/0138292 | A1 | 6/2012 | Miller |

FOREIGN PATENT DOCUMENTS

| | | | |
|---|---|---|---|
| WO | 2011021053 | A2 | 2/2011 |
| WO | 2011087721 | A1 | 7/2011 |
| WO | 2011163491 | A2 | 12/2011 |
| WO | 2011163491 | A8 | 12/2011 |

OTHER PUBLICATIONS

Foreign communication from a related counterpart application—International Search Report and Written Opinion, PCT/US2006/023947, Oct. 27, 2006, 8 pages.

Halliburton brochure entitled, "Horizontal Completion Systems", article H03280, Jun. 30, 2011, 14 pages.

Halliburton brochure entitled, "Delta Stim® Lite Sleeve", article H06033, Jun. 2010, 3 pages.

Filing Receipt and specification for patent application entitled "Injection of Fluid into Selected Ones of Multiple Zones with Well Tools Selectively Responsive to Magnetic Patterns," by Matthew Todd Howell, filed Aug. 29, 2011 as U.S. Appl. No. 13/219,790.

Smart Plugging Tool System for Selectively Actuating Wellbore Valves, originally published in Prior Art Database, dated Jan. 7, 2008, 5 pages.

* cited by examiner 30
28
28
28
111
111g
114
32b
111a
22
14
111e
111b
20
32a
115
110b
112
110
112a
112b
111f
102b
110c
110f
110d
116b
116a
116
110
32c
200
110e
116b
102a
116
116a
32d
22
102
48
46
45
106
14
20
40
42
36

200
32c
110e
110
116b
116
116a
30
28
28
28
111
32d
111g
114
22
32b
111a
22
48
46
111e
45
106
14
112
14
111b
20
20
32a
115
40
42
112b
111f
112a
110
36
110b
110c
110f
110d

METHOD OF COMPLETING A MULTI-ZONE FRACTURE STIMULATION TREATMENT OF A WELLBORE

CROSS-REFERENCE TO RELATED APPLICATIONS

The subject matter of this application is related to U.S. application Ser. No. 13/219,790, filed Aug. 29, 2011 and entitled "Injection of Fluid into Selected Ones of Multiple Zones with Well Tools Selectively Responsive to Magnetic Patterns," the entire disclosure of which is incorporated herein by this reference.

STATEMENT REGARDING FEDERALLY SPONSORED RESEARCH OR DEVELOPMENT

Not applicable.

REFERENCE TO A MICROFICHE APPENDIX

Not applicable.

BACKGROUND

This disclosure relates generally to equipment utilized and operations performed in conjunction with a subterranean well and, in an example described below, more particularly provides for injection of fluid into selected ones of multiple zones in a well, and provides for pressure sensing actuation of well tools.

It can be beneficial in some circumstances to individually, or at least selectively, inject fluid into multiple formation zones penetrated by a wellbore. For example, the fluid could be treatment, stimulation, fracturing, acidizing, conformance, or other type of fluid.

Therefore, it will be appreciated that improvements are continually needed in the art. These improvements could be useful in operations other than selectively injecting fluid into formation zones.

SUMMARY

Disclosed herein is a wellbore servicing tool comprising a housing comprising one or more ports and a flow passage, a triggering system, a first sliding sleeve slidably positioned within the housing and transitional from a first position to a second position, and a second sliding sleeve slidably positioned within the housing and transitional from a first position to a second position, wherein, when the first sliding sleeve is in the first position, the first sliding sleeve retains the second sliding sleeve in the first position and, when the first sliding sleeve is in the second position, the first sliding sleeve does not retain the second sliding sleeve in the first position, wherein, when the second sliding sleeve is in the first position, the second sliding sleeve prevents a route of fluid communication via the one or more ports of the housing and, when the second sliding sleeve is in the second position, the second sliding sleeve allows fluid communication via the one or more ports of the housing, and wherein the triggering system is configured to allow the first sliding sleeve to transition from the first position to the second position responsive to recognition of a predetermined signal, wherein the predetermined signal comprises a predetermined pressure signal, a predetermined temperature signal, a predetermined flow-rate signal, or combinations thereof.

Also disclosed herein is a wellbore servicing method comprising positioning a wellbore servicing tool within a wellbore penetrating the subterranean formation, wherein the well tool comprises a housing comprising one or more ports and a flow passage, a first sliding sleeve slidably positioned within the housing and transitional from a first position to a second position, a second sliding sleeve slidably positioned within the housing and transitional from a first position to a second position, and a triggering system, wherein, when the first sliding sleeve is in the first position, the first sliding sleeve retains the second sliding sleeve in the first position and, when the first sliding sleeve is in the second position, the first sliding sleeve does not retain the second sliding sleeve in the first position, wherein, when the second sliding sleeve is in the first position, the second sliding sleeve prevents a route of fluid communication via the one or more ports of the housing and, when the second sliding sleeve is in the second position, the second sliding sleeve allows fluid communication via the one or more ports of the housing, communicating a predetermined signal to the wellbore servicing tool, wherein the predetermined signal comprises a predetermined pressure signal, a predetermined temperature signal, a predetermined flow-rate signal, or combinations thereof, and wherein receipt of the predetermined signal by the triggering system allows the first sliding sleeve to transition from the first position to the second position, applying a hydraulic pressure of at least a predetermined threshold to the wellbore servicing tool, wherein the application of the hydraulic pressure causes the second sliding sleeve to transition from the first position to the second position, and communicating a wellbore servicing fluid via the ports.

Further disclosed herein is a wellbore servicing method comprising positioning a tubular sting having a wellbore servicing tool therein within a wellbore, communicating a predetermined signal to the wellbore servicing tool, wherein the predetermined signal comprises a predetermined pressure signal, a predetermined temperature signal, a predetermined flow-rate signal, or combinations thereof, applying a hydraulic fluid pressure to the wellbore servicing tool, wherein communicating the predetermined signal to the wellbore servicing tool, followed by the application of the hydraulic fluid pressure to the wellbore servicing tool, configures the tool for the communication of a wellbore servicing fluid to a proximate formation zone, and communicating the wellbore servicing fluid to the proximate formation zone.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
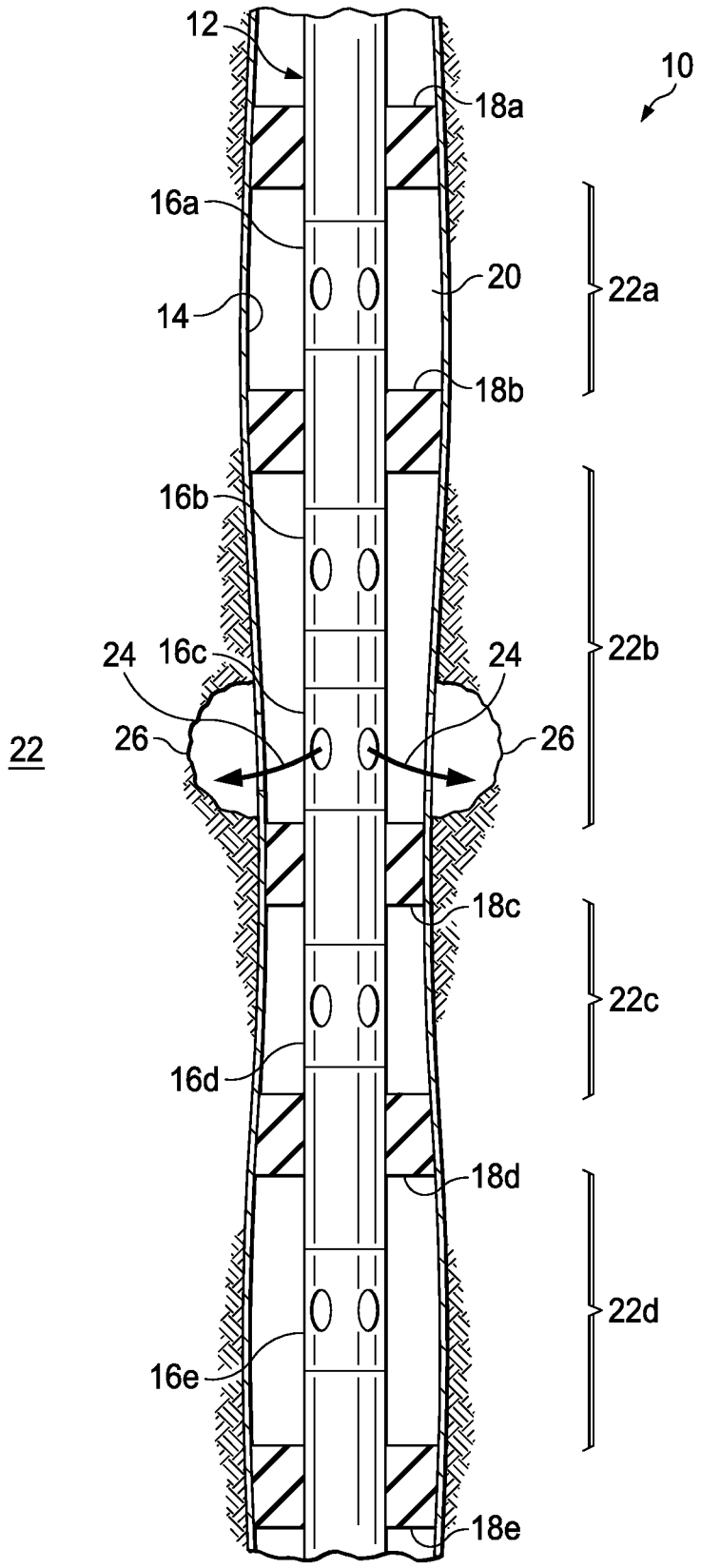
FIG. 1 is a representative partially cross-sectional view of a well system and associated method which can embody principles of this disclosure.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Representatively illustrated in FIG. 1 is a system 10 for use with a well, and an associated method, which can embody principles of this disclosure. In this example, a tubular string 12 is positioned in a wellbore 14, with the tubular string having multiple injection valves 16*a-e* and packers 18*a-e* interconnected therein.

The tubular string 12 may be of the type known to those skilled in the art as casing, liner, tubing, a production string, a work string, etc. Any type of tubular string may be used and remain within the scope of this disclosure.

The packers 18*a-e* seal off an annulus 20 formed radially between the tubular string 12 and the wellbore 14. The packers 18*a-e* in this example are designed for sealing engagement with an uncased or open hole wellbore 14, but if the wellbore is cased or lined, then cased hole-type packers may be used instead. Swellable, inflatable, expandable and other types of packers may be used, as appropriate for the well conditions, or no packers may be used (for example, the tubular string 12 could be expanded into contact with the wellbore 14, the tubular string could be cemented in the wellbore, etc.).

In the FIG. 1 example, the injection valves 16*a-e* permit selective fluid communication between an interior of the tubular string 12 and each section of the annulus 20 isolated between two of the packers 18*a-e*. Each section of the annulus 20 is in fluid communication with a corresponding earth formation zone 22*a-d*. Of course, if packers 18*a-e* are not used, then the injection valves 16*a-e* can otherwise be placed in communication with the individual zones 22*a-d*, for example, with perforations, etc.

The zones 22*a-d* may be sections of a same formation 22, or they may be sections of different formations. Each zone 22*a-d* may be associated with one or more of the injection valves 16*a-e*.

In the FIG. 1 example, two injection valves 16*b,c* are associated with the section of the annulus 20 isolated between the packers 18*b,c*, and this section of the annulus is in communication with the associated zone 22*b*. It will be appreciated that any number of injection valves may be associated with a zone.

It is sometimes beneficial to initiate fractures 26 at multiple locations in a zone (for example, in tight shale formations, etc.), in which cases the multiple injection valves can provide for injecting fluid 24 at multiple fracture initiation points along the wellbore 14. In the example depicted in FIG. 1, the valve 16*c* has been opened, and fluid 24 is being injected into the zone 22*b*, thereby forming the fractures 26.

Preferably, the other valves 16*a,b,d,e* are closed while the fluid 24 is being flowed out of the valve 16*c* and into the zone 22*b*. This enables all of the fluid 24 flow to be directed toward forming the fractures 26, with enhanced control over the operation at that particular location.

However, in other examples, multiple valves 16*a-e* could be open while the fluid 24 is flowed into a zone of an earth formation 22. In the well system 10, for example, both of the valves 16*b,c* could be open while the fluid 24 is flowed into the zone 22*b*. This would enable fractures to be formed at multiple fracture initiation locations corresponding to the open valves.

It will, thus, be appreciated that it would be beneficial to be able to open different sets of one or more of the valves 16*a-e* at different times. For example, one set (such as valves 16*b,c*) could be opened at one time (such as, when it is desired to form fractures 26 into the zone 22*b*), and another set (such as valve 16*a*) could be opened at another time (such as, when it is desired to form fractures into the zone 22*a*).

One or more sets of the valves 16*a-e* could be open simultaneously. However, it is generally preferable for only one set of the valves 16*a-e* to be open at a time, so that the fluid 24 flow can be concentrated on a particular zone, and so flow into that zone can be individually controlled.

At this point, it should be noted that the well system 10 and method is described here and depicted in the drawings as merely one example of a wide variety of possible systems and methods which can incorporate the principles of this disclosure. Therefore, it should be understood that those principles are not limited in any manner to the details of the system 10 or associated method, or to the details of any of the components thereof (for example, the tubular string 12, the wellbore 14, the valves 16*a-e*, the packers 18*a-e*, etc.).

It is not necessary for the wellbore 14 to be vertical as depicted in FIG. 1, for the wellbore to be uncased, for there to be five each of the valves 16*a-e* and packers, for there to be four of the zones 22*a-d*, for fractures 26 to be formed in the zones, etc. The fluid 24 could be any type of fluid which is injected into an earth formation, e.g., for stimulation, conformance, acidizing, fracturing, water-flooding, steam-flooding, treatment, or any other purpose. Thus, it will be appreciated that the principles of this disclosure are applicable to many different types of well systems and operations.

In other examples, the principles of this disclosure could be applied in circumstances where fluid is not only injected, but is also (or only) produced from the formation 22. Thus, well tools other than injection valves can benefit from the principles described herein.

Figure 2:
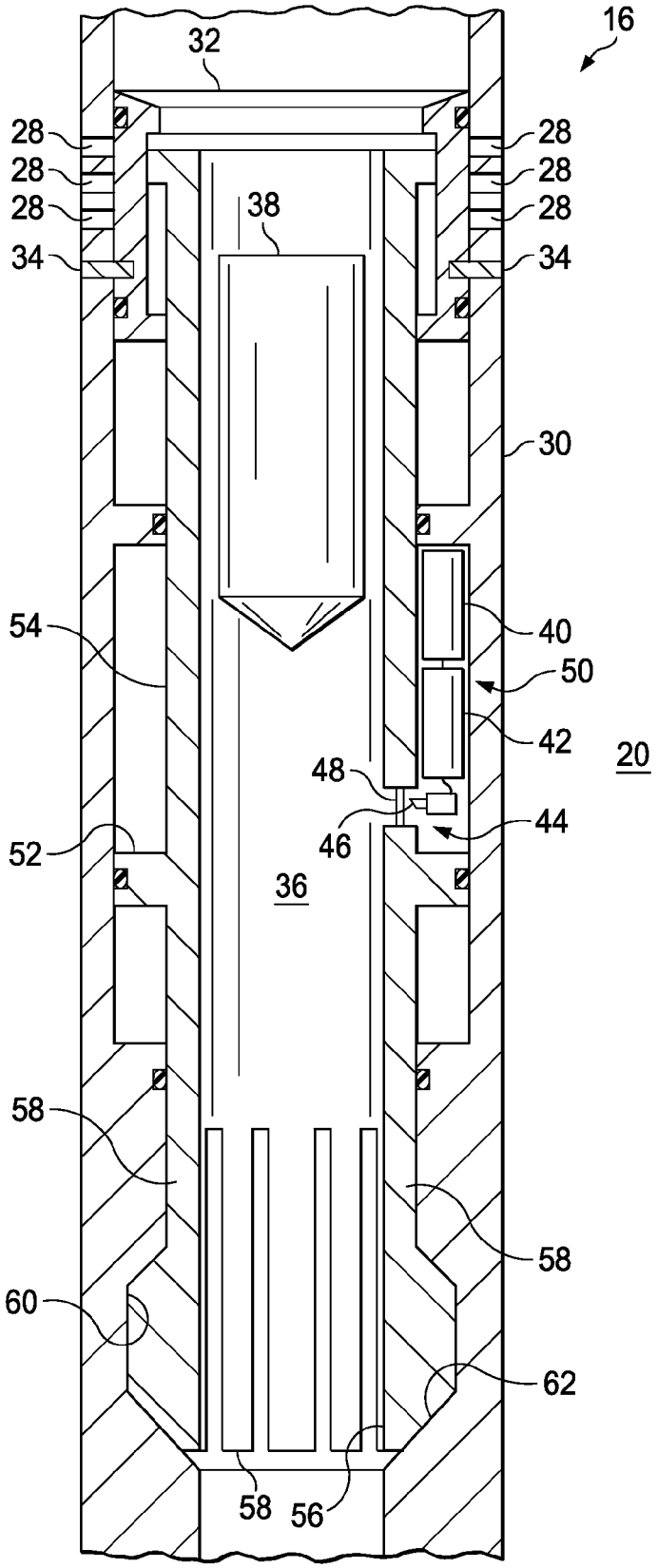
FIG. 2 is a representative cross-sectional view of an injection valve which may be used in the well system and method, and which can embody the principles of this disclosure.

Referring additionally now to FIG. 2, an enlarged scale cross-sectional view of one example of the injection valve 16 is representatively illustrated. The injection valve 16 of FIG. 2 may be used in the well system 10 and method of FIG. 1, or it may be used in other well systems and methods, while still remaining within the scope of this disclosure.

In the FIG. 2 example, the valve 16 includes openings 28 in a sidewall of a generally tubular housing 30. The openings 28 are blocked by a sleeve 32, which is retained in position by shear members 34.

In this configuration, fluid communication is prevented between the annulus 20 external to the valve 16, and an internal flow passage 36 which extends longitudinally through the valve (and which extends longitudinally through the tubular string 12 when the valve is interconnected therein). The valve 16 can be opened, however, by shearing the shear members 34 and displacing the sleeve 32 (downward as viewed in FIG. 2) to a position in which the sleeve does not block the openings 28.

To open the valve 16, a magnetic device 38 is displaced into the valve to activate an actuator 50 thereof. The magnetic device 38 is depicted in FIG. 2 as being generally cylindrical, but other shapes and types of magnetic devices (such as, balls, darts, plugs, fluids, gels, etc.) may be used in other examples. For example, a ferrofluid, magnetorheological fluid, or any other fluid having magnetic properties which can be sensed by the sensor 40, could be pumped to or past the sensor in order to transmit a magnetic signal to the actuator 50.

The magnetic device 38 may be displaced into the valve 16 by any technique. For example, the magnetic device 38 can be dropped through the tubular string 12, pumped by flowing fluid through the passage 36, self-propelled, conveyed by wireline, slickline, coiled tubing, etc.

The magnetic device 38 has known magnetic properties, and/or produces a known magnetic field, or pattern or combination of magnetic fields, which is/are detected by a magnetic sensor 40 of the valve 16. The magnetic sensor 40 can be any type of sensor which is capable of detecting the presence of the magnetic field(s) produced by the magnetic device 38, and/or one or more other magnetic properties of the magnetic device.

Suitable sensors include (but are not limited to) giant magneto-resistive (GMR) sensors, Hall-effect sensors, conductive coils, etc. Permanent magnets can be combined with the magnetic sensor 40 in order to create a magnetic field that is disturbed by the magnetic device 38. A change in the magnetic field can be detected by the sensor 40 as an indication of the presence of the magnetic device 38.

The sensor 40 is connected to electronic circuitry 42 which determines whether the sensor has detected a particular predetermined magnetic field, or pattern or combination of magnetic fields, or other magnetic properties of the magnetic device 38. For example, the electronic circuitry 42 could have the predetermined magnetic field(s) or other magnetic properties programmed into non-volatile memory for comparison to magnetic fields/properties detected by the sensor 40. The electronic circuitry 42 could be supplied with electrical power via an on-board battery, a downhole generator, or any other electrical power source.

In one example, the electronic circuitry 42 could include a capacitor, wherein an electrical resonance behavior between the capacitance of the capacitor and the magnetic sensor 40 changes, depending on whether the magnetic device 38 is present. In another example, the electronic circuitry 42 could include an adaptive magnetic field that adjusts to a baseline magnetic field of the surrounding environment (e.g., the formation 22, surrounding metallic structures, etc.). The electronic circuitry 42 could determine whether the measured magnetic fields exceed the adaptive magnetic field level.

In one example, the sensor 40 could comprise an inductive sensor which can detect the presence of a metallic device (e.g., by detecting a change in a magnetic field, etc.). The metallic device (such as a metal ball or dart, etc.) can be considered a magnetic device 38, in the sense that it conducts a magnetic field and produces changes in a magnetic field which can be detected by the sensor 40.

If the electronic circuitry 42 determines that the sensor 40 has detected the predetermined magnetic field(s) or change(s) in magnetic field(s), the electronic circuitry causes a valve device 44 to open. In this example, the valve device 44 includes a piercing member 46 which pierces a pressure barrier 48.

The piercing member 46 can be driven by any means, such as, by an electrical, hydraulic, mechanical, explosive, chemical or other type of actuator. Other types of valve devices 44 (such as those described in U.S. patent application Ser. Nos. 12/688,058 and 12/353,664, the entire disclosures of which are incorporated herein by this reference) may be used, in keeping with the scope of this disclosure.

When the valve device 44 is opened, a piston 52 on a mandrel 54 becomes unbalanced (e.g., a pressure differential is created across the piston), and the piston displaces downward as viewed in FIG. 2. This displacement of the piston 52 could, in some examples, be used to shear the shear members 34 and displace the sleeve 32 to its open position.

However, in the FIG. 2 example, the piston 52 displacement is used to activate a retractable seat 56 to a sealing position thereof. As depicted in FIG. 2, the retractable seat 56 is in the form of resilient collets 58 which are initially received in an annular recess 60 formed in the housing 30. In this position, the retractable seat 56 is retracted, and is not capable of sealingly engaging the magnetic device 38 or any other form of plug in the flow passage 36.

When the piston 52 displaces downward, the collets 58 are deflected radially inward by an inclined face 62 of the recess 60, and the seat 56 is then in its sealing position. A plug (such as, a ball, a dart, a magnetic device 38, etc.) can sealingly engage the seat 56, and increased pressure can be applied to the passage 36 above the plug to thereby shear the shear members 34 and downwardly displace the sleeve 32 to its open position.

As mentioned above, the retractable seat 56 may be sealingly engaged by the magnetic device 38 which initially activates the actuator 50 (e.g., in response to the sensor 40 detecting the predetermined magnetic field(s) or change(s) in magnetic field(s) produced by the magnetic device), or the retractable seat may be sealingly engaged by another magnetic device and/or plug subsequently displaced into the valve 16.

Furthermore, the retractable seat 56 may be actuated to its sealing position in response to displacement of more than one magnetic device 38 into the valve 16. For example, the electronic circuitry 42 may not actuate the valve device 44 until a predetermined number of the magnetic devices 38 have been displaced into the valve 16, and/or until a predetermined spacing in time is detected, etc.

Figure 3:
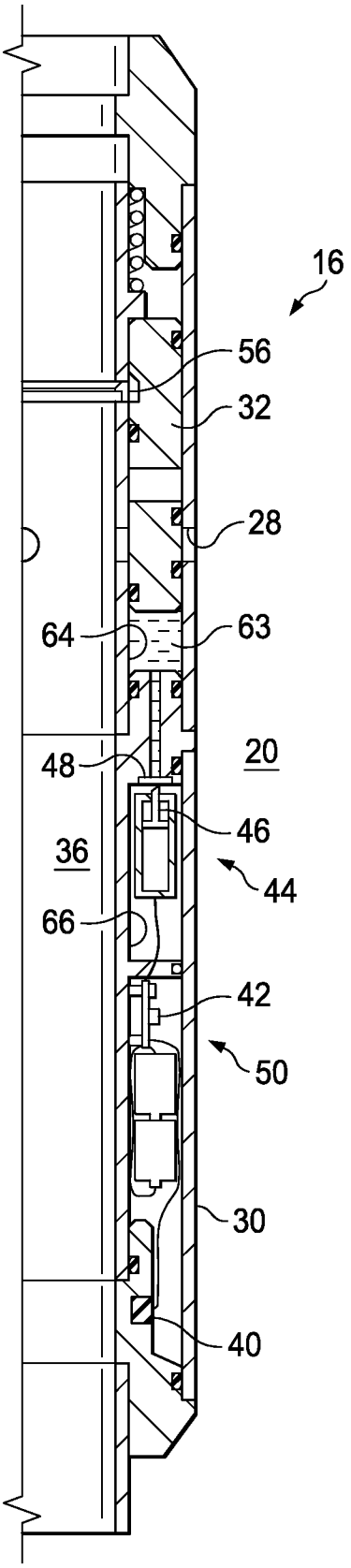
FIGS. 3-6 are a representative cross-sectional views of another example of the injection valve, in run-in, actuated and reverse flow configurations thereof.

Referring additionally now to FIGS. 3-6, another example of the injection valve 16 is representatively illustrated. In this example, the sleeve 32 is initially in a closed position, as depicted in FIG. 3. The sleeve 32 is displaced to its open position (see FIG. 4) when a support fluid 63 is flowed from one chamber 64 to another chamber 66.

Figure 4:
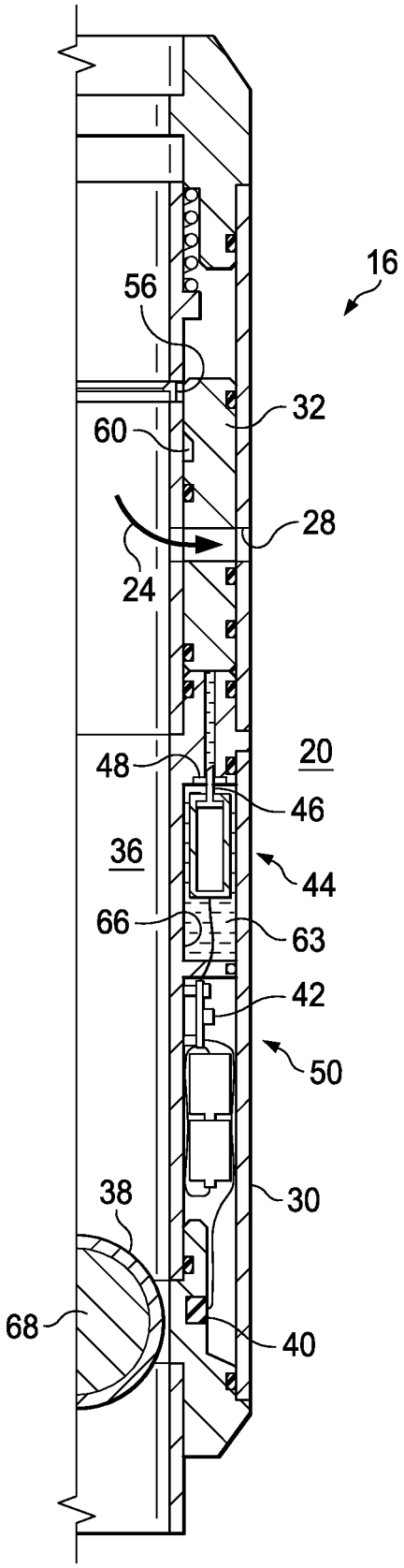

The chambers 64, 66 are initially isolated from each other by the pressure barrier 48. When the sensor 40 detects the predetermined magnetic signal(s) produced by the magnetic device(s) 38, the piercing member 46 pierces the pressure barrier 48, and the support fluid 63 flows from the chamber 64 to the chamber 66, thereby allowing a pressure differential across the sleeve 32 to displace the sleeve downward to its open position, as depicted in FIG. 4.

Fluid 24 can now be flowed outward through the openings 28 from the passage 36 to the annulus 20. Note that the retractable seat 56 is now extended inwardly to its sealing position. In this example, the retractable seat 56 is in the form of an expandable ring which is extended radially inward to its sealing position by the downward displacement of the sleeve 32.

In addition, note that the magnetic device 38 in this example comprises a ball or sphere. Preferably, one or more permanent magnets 68 or other type of magnetic field-producing components are included in the magnetic device 38.

Figure 5:
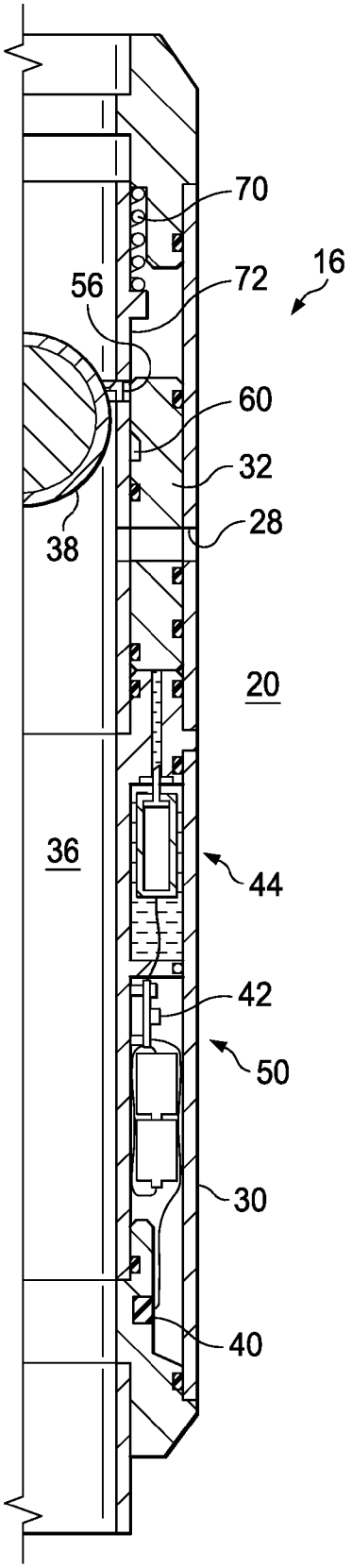

In FIG. 5, the magnetic device 38 is retrieved from the passage 36 by reverse flow of fluid through the passage 36 (e.g., upward flow as viewed in FIG. 5). The magnetic device 38 is conveyed upwardly through the passage 36 by this reverse flow, and eventually engages in sealing contact with the seat 56, as depicted in FIG. 5.

Figure 6:
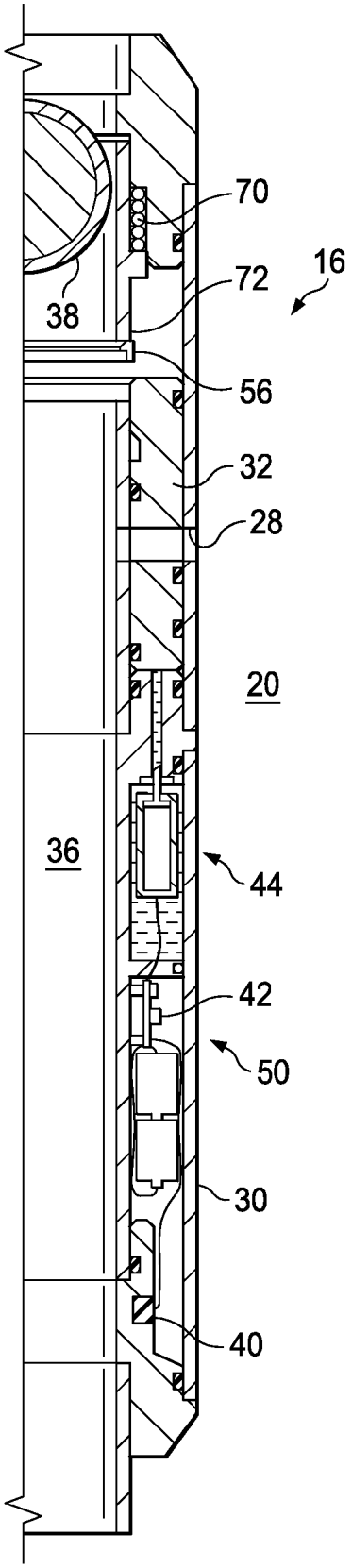

In FIG. 6, a pressure differential across the magnetic device 38 and seat 56 causes them to be displaced upward against a downward biasing force exerted by a spring 70 on a retainer sleeve 72. When the biasing force is overcome, the magnetic device 38, seat 56 and sleeve 72 are displaced upward, thereby allowing the seat 56 to expand outward to its retracted position, and allowing the magnetic device 38 to be conveyed upward through the passage 36, e.g., for retrieval to the surface.

Note that in the FIGS. 2 & 3-6 examples, the seat 58 is initially expanded or "retracted" from its sealing position, and is later deflected inward to its sealing position. In the FIGS. 3-6 example, the seat 58 can then be again expanded (see FIG. 6) for retrieval of the magnetic device 38 (or to otherwise minimize obstruction of the passage 36).

The seat 58 in both of these examples can be considered "retractable," in that the seat can be in its inward sealing position, or in its outward non-sealing position, when desired. Thus, the seat 58 can be in its non-sealing position when initially installed, and then can be actuated to its sealing position (e.g., in response to detection of a predetermined pattern or combination of magnetic fields), without later being actuated to its sealing position again, and still be considered a "retractable" seat.

Figure 7:
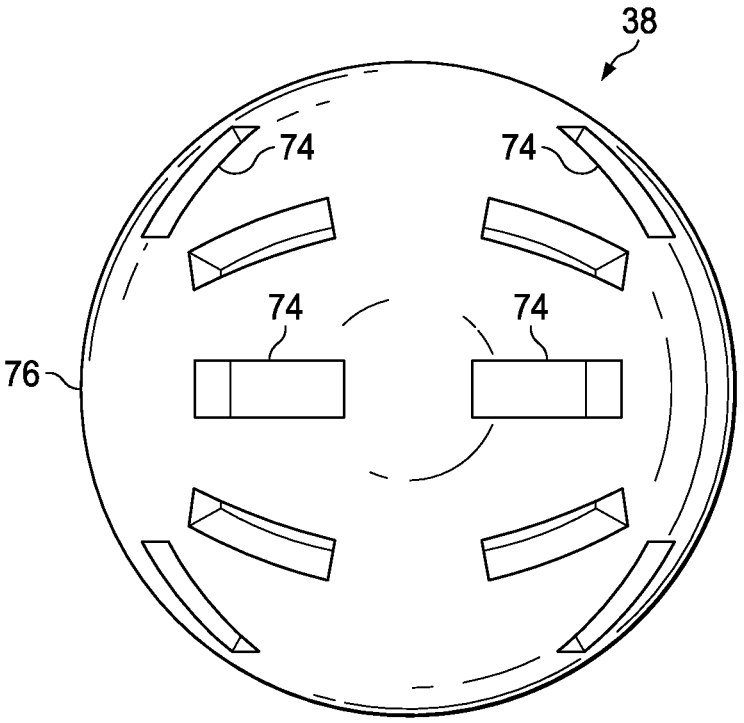
FIGS. 7 & 8 are representative side and plan views of a magnetic device which may be used with the injection valve.
Figure 8:
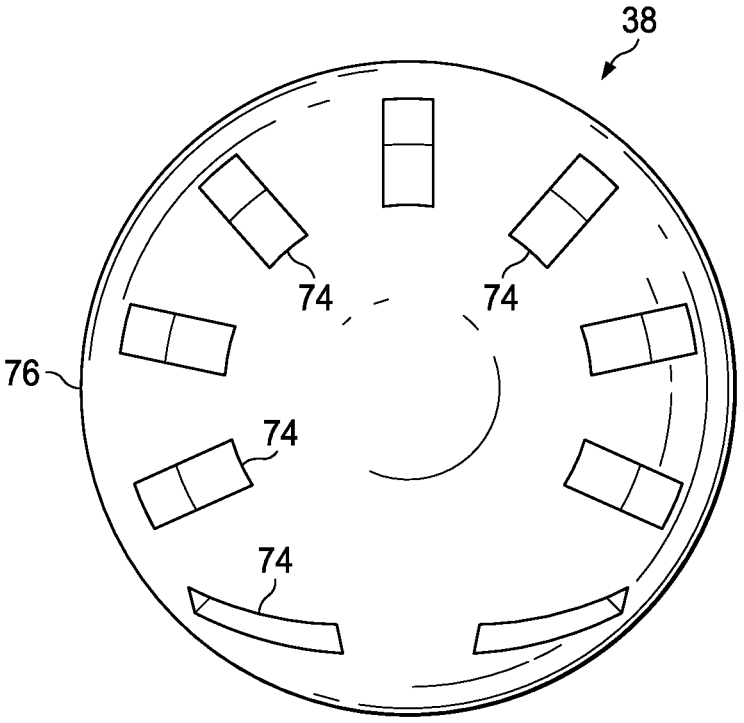

Referring additionally now to FIGS. 7 & 8, another example of the magnetic device 38 is representatively illustrated. In this example, magnets (not shown in FIGS. 7 & 8, see, e.g., permanent magnet 68 in FIG. 4) are retained in recesses 74 formed in an outer surface of a sphere 76.

The recesses 74 are arranged in a pattern which, in this case, resembles that of stitching on a baseball. In FIGS. 7 & 8, the pattern comprises spaced apart positions distributed along a continuous undulating path about the sphere 76. However, it should be clearly understood that any pattern of magnetic field-producing components may be used in the magnetic device 38, in keeping with the scope of this disclosure.

The magnets 68 are preferably arranged to provide a magnetic field a substantial distance from the device 38, and to do so no matter the orientation of the sphere 76. The pattern depicted in FIGS. 7 & 8 desirably projects the produced magnetic field(s) substantially evenly around the sphere 76.

Figure 9:
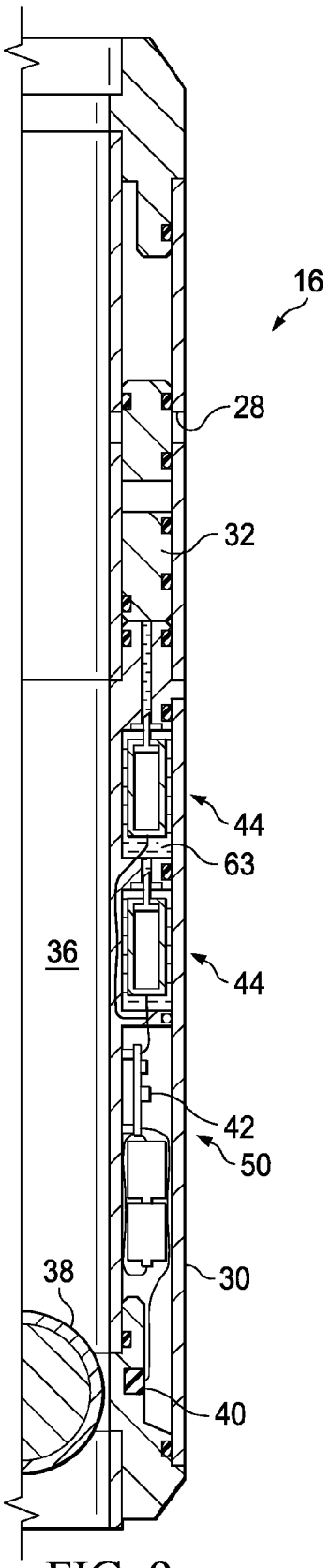
FIG. 9 is a representative cross-sectional view of another example of the injection valve.

Referring additionally now to FIG. 9, another example of the injection valve 16 is representatively illustrated. In this example, the actuator 50 includes two of the valve devices 44.

When one of the valve devices 44 opens, a sufficient amount of the support fluid 63 is drained to displace the sleeve 32 to its open position (similar to, e.g., FIG. 4), in which the fluid 24 can be flowed outward through the openings 28. When the other valve device 44 opens, more of the support fluid 63 is drained, thereby further displacing the sleeve 32 to a closed position (as depicted in FIG. 9), in which flow through the openings 28 is prevented by the sleeve.

Various different techniques may be used to control actuation of the valve devices 44. For example, one of the valve devices 44 may be opened when a first magnetic device 38 is displaced into the valve 16, and the other valve device may be opened when a second magnetic device is displaced into the valve. As another example, the second valve device 44 may be actuated in response to passage of a predetermined amount of time from a particular magnetic device 38, or a predetermined number of magnetic devices, being detected by the sensor 40.

As yet another example, the first valve device 44 may actuate when a certain number of magnetic devices 38 have been displaced into the valve 16, and the second valve device 44 may actuate when another number of magnetic devices have been displaced into the valve. Thus, it should be understood that any technique for controlling actuation of the valve devices 44 may be used, in keeping with the scope of this disclosure.

Figure 10A:
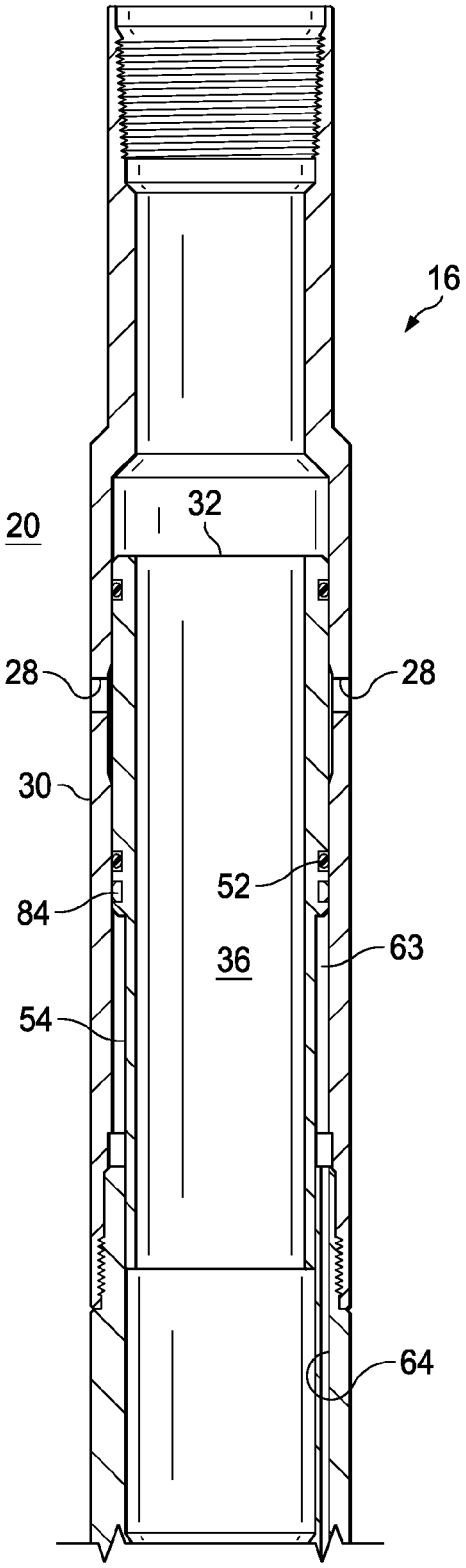
FIGS. 10A & B are representative cross-sectional views of successive axial sections of another example of the injection valve, in a closed configuration.
Figure 10B:
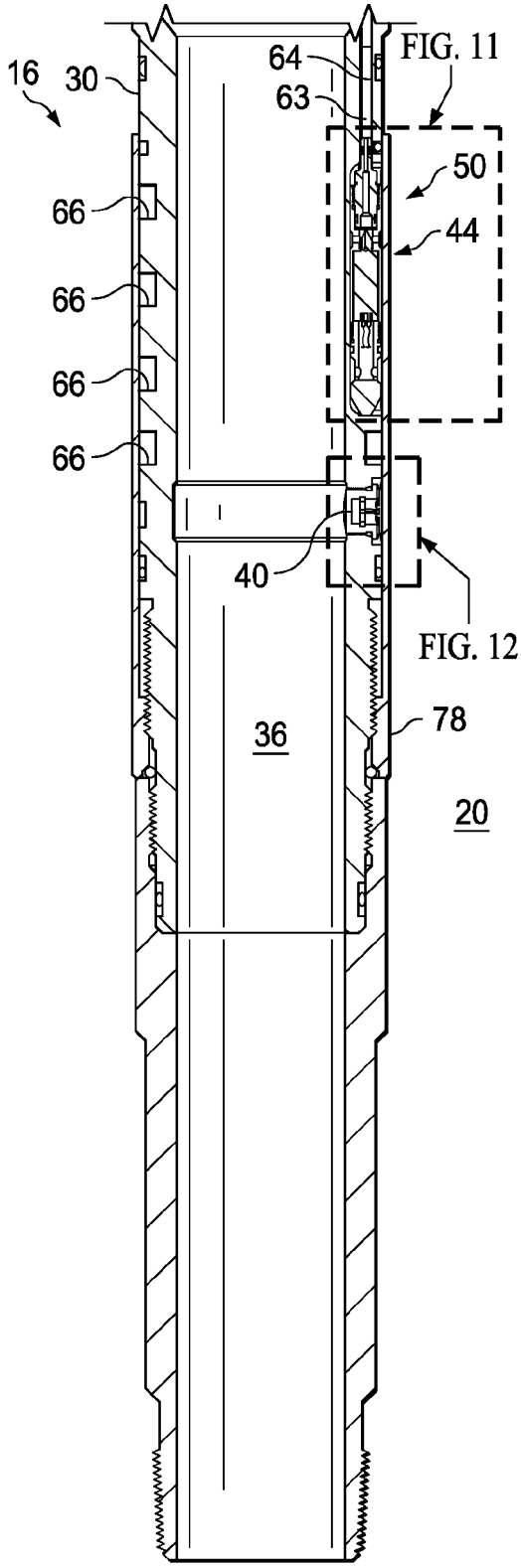
Figure 11:
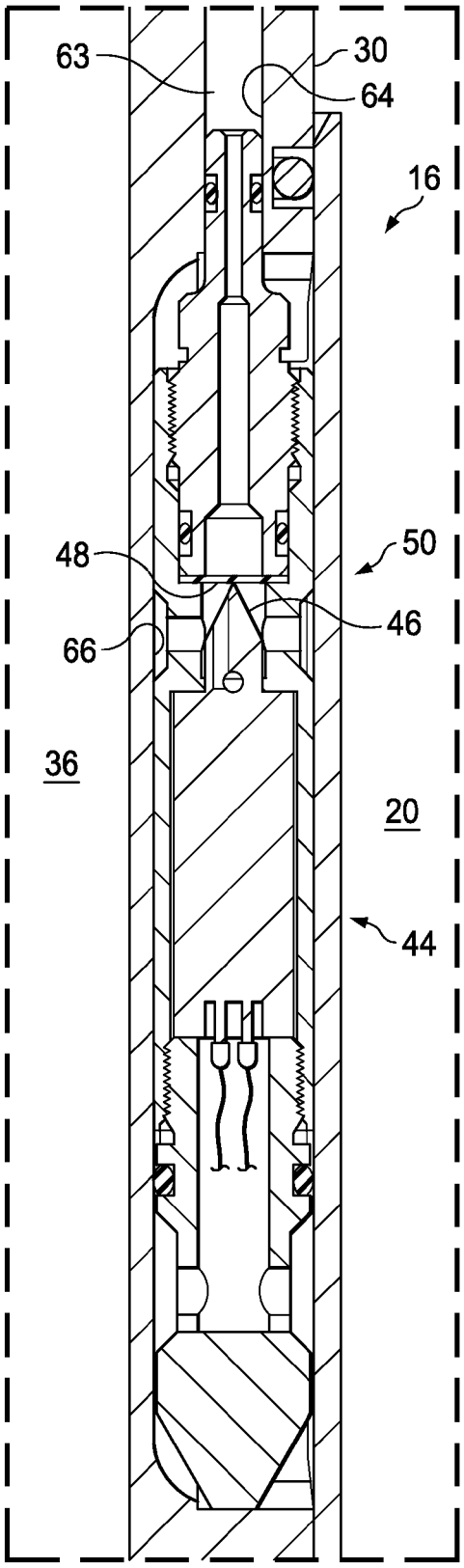
FIG. 11 is an enlarged scale representative cross-sectional view of a valve device which may be used in the injection valve.
Figure 12:
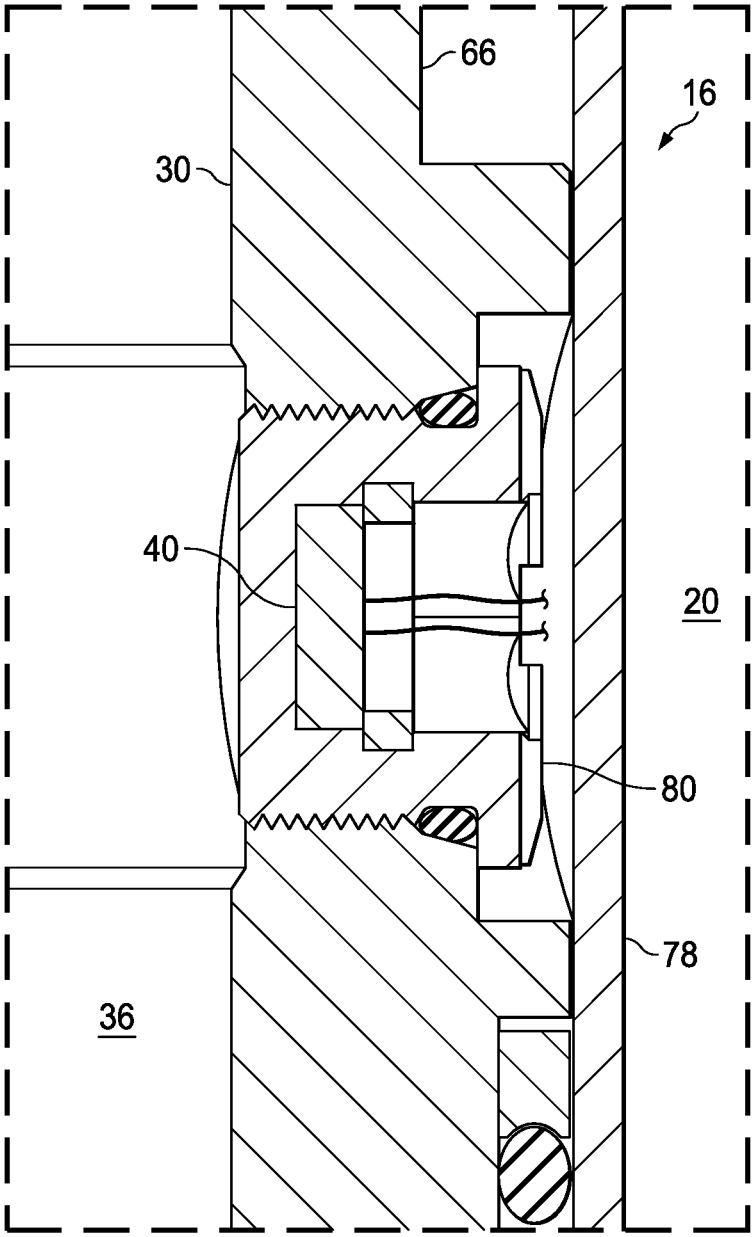
FIG. 12 is an enlarged scale representative cross-sectional view of a magnetic sensor which may be used in the injection valve.

Referring additionally now to FIGS. 10A-13B, another example of the injection valve 16 is representatively illustrated. In FIGS. 10A & B, the valve 16 is depicted in a closed configuration, whereas in FIGS. 13A & B, the valve is depicted in an open configuration. FIG. 11 depicts an enlarged scale view of the actuator 50. FIG. 12 depicts an enlarged scale view of the magnetic sensor 40.

In FIGS. 10A & B, it may be seen that the support fluid 63 is contained in the chamber 64, which extends as a passage to the actuator 50. In addition, the chamber 66 comprises multiple annular recesses extending about the housing 30. A sleeve 78 isolates the chamber 66 and actuator 50 from well fluid in the annulus 20.

In FIG. 11, the manner in which the pressure barrier 48 isolates the chamber 64 from the chamber 66 can be more clearly seen. When the valve device 44 is actuated, the piercing member 46 pierces the pressure barrier 48, allowing the support fluid 63 to flow from the chamber 64 to the chamber 66 in which the valve device 44 is located.

Initially, the chamber 66 is at or near atmospheric pressure, and contains air or an inert gas. Thus, the support fluid 63 can readily flow into the chamber 66, allowing the sleeve 32 to displace downwardly, due to the pressure differential across the piston 52.

In FIG. 12, the manner in which the magnetic sensor 40 is positioned for detecting magnetic fields and/or magnetic field changes in the passage 36 can be clearly seen. In this example, the magnetic sensor 40 is mounted in a nonmagnetic plug 80 secured in the housing 30 in close proximity to the passage 36.

Figure 13A:
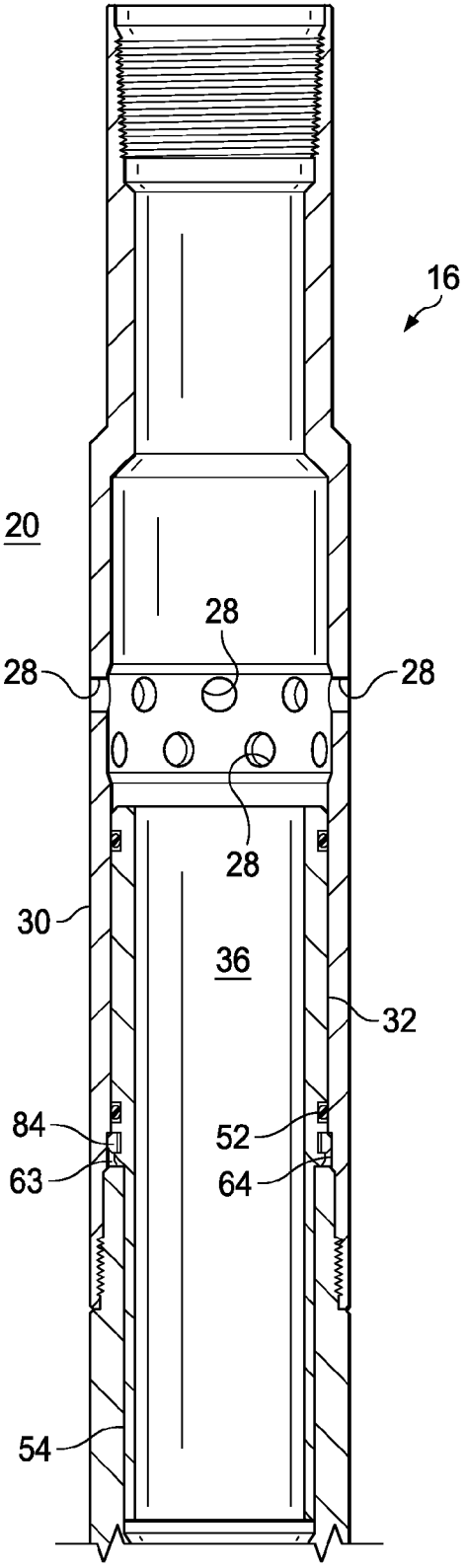
FIGS. 13A & B are representative cross-sectional views of successive axial sections of the injection valve, in an open configuration.
Figure 13B:
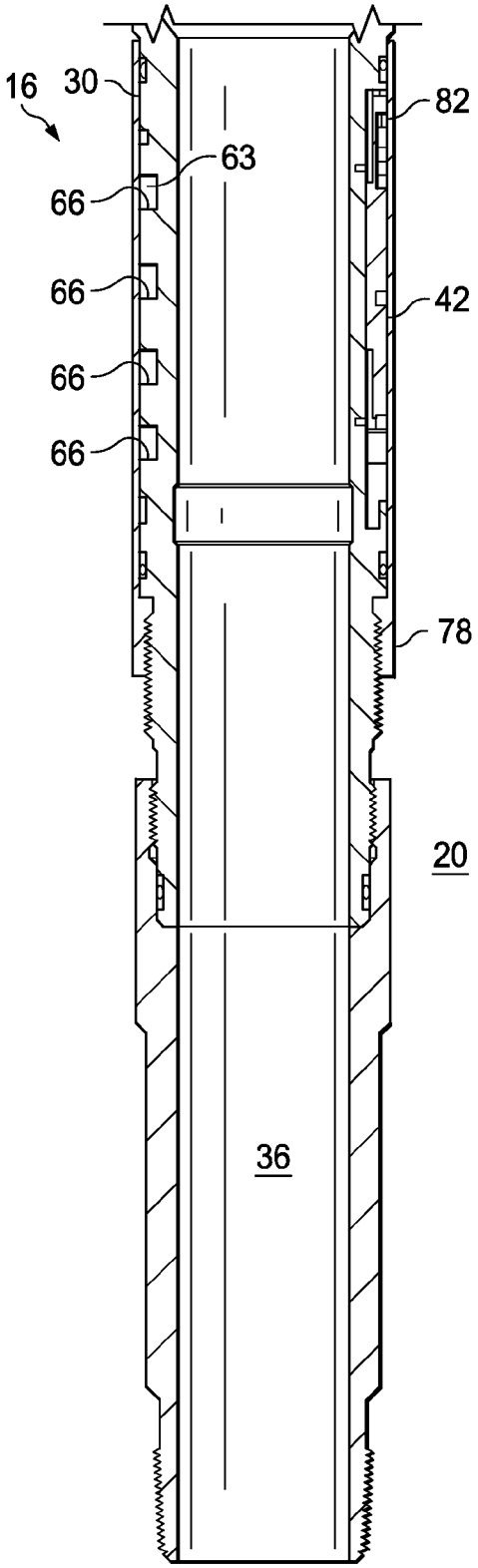

In FIGS. 13A & B, the injection valve 16 is depicted in an open configuration, after the valve device 44 has been actuated to cause the piercing member 46 to pierce the pressure barrier 48. The support fluid 63 has drained into the chamber 66, allowing the sleeve 32 to displace downward and uncover the openings 28, and thereby permitting flow through the sidewall of the housing 30.

A locking member 84 (such as a resilient C-ring) expands outward when the sleeve 32 displaces to its open position. When expanded, the locking member 84 prevents re-closing of the sleeve 32.

The actuator 50 is not visible in FIGS. 13A & B, since the cross-sectional view depicted in FIGS. 13A & B is rotated somewhat about the injection valve's longitudinal axis. In this view, the electronic circuitry 42 is visible, disposed between the housing 30 and the outer sleeve 78.

A contact 82 is provided for interfacing with the electronic circuitry 42 (for example, comprising a hybridized circuit with a programmable processor, etc.), and for switching the electronic circuitry on and off. With the outer sleeve 78 in a downwardly displaced position (as depicted in FIGS. 10A & B), the contact 82 can be accessed by an operator. The outer sleeve 78 would be displaced to its upwardly disposed position (as depicted in FIGS. 13A & B) prior to installing the valve 16 in a well.

Although in the examples of FIGS. 2-13B, the sensor 40 is depicted as being included in the valve 16, it will be appreciated that the sensor could be otherwise positioned. For example, the sensor 40 could be located in another housing interconnected in the tubular string 12 above or below one or more of the valves 16*a-e* in the system 10 of FIG. 1. Multiple sensors 40 could be used, for example, to detect a pattern of magnetic field-producing components on a magnetic device 38. Thus, it should be understood that the scope of this disclosure is not limited to any particular positioning or number of the sensor(s) 40.

In examples described above, the sensor 40 can detect magnetic signals which correspond to displacing one or more magnetic devices 38 in the well (e.g., through the passage 36, etc.) in certain respective patterns. The transmitting of different magnetic signals (corresponding to respective different patterns of displacing the magnetic devices 38) can be used to actuate corresponding different sets of the valves 16*a-e*.

Thus, displacing a pattern of magnetic devices 38 in a well can be used to transmit a corresponding magnetic signal to well tools (such as valves 16*a-e*, etc.), and at least one of the well tools can actuate in response to detection of the magnetic signal. The pattern may comprise a predetermined number of the magnetic devices 38, a predetermined spacing in time of the magnetic devices 38, or a predetermined spacing on time between predetermined numbers of the magnetic devices 38, etc. Any pattern may be used in keeping with the scope of this disclosure.

The magnetic device pattern can comprise a predetermined magnetic field pattern (such as, the pattern of magnetic field-producing components on the magnetic device 38 of FIGS. 7 & 8, etc.), a predetermined pattern of multiple magnetic fields (such as, a pattern produced by displacing multiple magnetic devices 38 in a certain manner through the well, etc.), a predetermined change in a magnetic field (such as, a change produced by displacing a metallic device past or to the sensor 40), and/or a predetermined pattern of multiple magnetic field changes (such as, a pattern produced by displacing multiple metallic devices in a certain manner past or to the sensor 40, etc.). Any manner of producing a magnetic device pattern may be used, within the scope of this disclosure.

A first set of the well tools might actuate in response to detection of a first magnetic signal. A second set of the well tools might actuate in response to detection of another magnetic signal. The second magnetic signal can correspond to a second unique magnetic device pattern produced in the well.

The term "pattern" is used in this context to refer to an arrangement of magnetic field-producing components (such as permanent magnets 68, etc.) of a magnetic device 38 (as in the FIGS. 7 & 8 example), and to refer to a manner in which multiple magnetic devices can be displaced in a well. The sensor 40 can, in some examples, detect a pattern of magnetic field-producing components of a magnetic device 38. In other examples, the sensor 40 can detect a pattern of displacing multiple magnetic devices.

The sensor 40 may detect a pattern on a single magnetic device 38, such as the magnetic device of FIGS. 7 & 8. In another example, magnetic field-producing components could be axially spaced on a magnetic device 38, such as a dart, rod, etc. In some examples, the sensor 40 may detect a pattern of different North-South poles of the magnetic device 38. By detecting different patterns of different magnetic field-producing components, the electronic circuitry 42 can determine whether an actuator 50 of a particular well tool should actuate or not, should actuate open or closed, should actuate more open or more closed, etc.

The sensor 40 may detect patterns created by displacing multiple magnetic devices 38 in the well. For example, three magnetic devices 38 could be displaced in the valve 16 (or past or to the sensor 40) within three minutes of each other, and then no magnetic devices could be displaced for the next three minutes.

The electronic circuitry 42 can receive this pattern of indications from the sensor 40, which encodes a digital command for communicating with the well tools (e.g., "waking" the well tool actuators 50 from a low power consumption "sleep" state). Once awakened, the well tool actuators 50 can, for example, actuate in response to respective predetermined numbers, timing, and/or other patterns of magnetic devices 38 displacing in the well. This method can help prevent extraneous activities (such as, the passage of wireline tools, etc. through the valve 16) from being misidentified as an operative magnetic signal.

In one example, the valve 16 can open in response to a predetermined number of magnetic devices 38 being displaced through the valve. By setting up the valves 16*a-e* in the system 10 of FIG. 1 to open in response to different numbers of magnetic devices 38 being displaced through the valves, different ones of the valves can be made to open at different times.

For example, the valve 16*e* could open when a first magnetic device 38 is displaced through the tubular string 12. The valve 16*d* could then be opened when a second magnetic device 38 is displaced through the tubular string 12. The valves 16*b,c* could be opened when a third magnetic device 38 is displaced through the tubular string 12. The valve 16*a* could be opened when a fourth magnetic device 38 is displaced through the tubular string 12.

Any combination of number of magnetic device(s) 38, pattern on one or more magnetic device(s), pattern of magnetic devices, spacing in time between magnetic devices, etc., can be detected by the magnetic sensor 40 and evaluated by the electronic circuitry 42 to determine whether the valve 16 should be actuated. Any unique combination of number of magnetic device(s) 38, pattern on one or more magnetic device(s), pattern of magnetic devices, spacing in time between magnetic devices, etc., may be used to select which of multiple sets of valves 16 will be actuated.

Another use for the actuator 50 (in any of its FIGS. 2-13B configurations) could be in actuating multiple injection valves. For example, the actuator 50 could be used to actuate multiple ones of the RAPIDFRAC™ Sleeve marketed by Halliburton Energy Services, Inc. of Houston, Tex. USA. The actuator 50 could initiate metering of a hydraulic fluid in the RAPIDFRAC™ Sleeves in response to a particular magnetic device 38 being displaced through them, so that all of them open after a certain period of time.

It may now be fully appreciated that the above disclosure provides several advancements to the art. The injection valve 16 can be conveniently and reliably opened by displacing the magnetic device 38 into the valve, or otherwise detecting a particular magnetic signal by a sensor of the valve. Selected ones or sets of injection valves 16 can be individually opened, when desired, by displacing a corresponding one or more magnetic devices 38 into the selected valve(s). The magnetic device(s) 38 may have a predetermined pattern of magnetic field-producing components, or otherwise emit a predetermined combination of magnetic fields, in order to actuate a corresponding predetermined set of injection valves 16*a-e*.

The above disclosure describes a method of injecting fluid 24 into selected ones of multiple zones 22*a-d* penetrated by a wellbore 14. In one example, the method can include producing a magnetic pattern, at least one valve 16 actuating in response to the producing step, and injecting the fluid 24 through the valve 16 and into at least one of the zones 22*a-d* associated with the valve 16. The valve(s) 16 could actuate to an open (or at least more open, from partially open to fully open, etc.) configuration in response to the magnetic pattern producing step.

The valve 16 may actuate in response to displacing a predetermined number of magnetic devices 38 into the valve 16.

A retractable seat 56 may be activated to a sealing position in response to the displacing step.

The valve 16 may actuate in response to a magnetic device 38 having a predetermined magnetic pattern, in response to a predetermined magnetic signal being transmitted from the magnetic device 38 to the valve, and/or in response to a sensor 40 of the valve 16 detecting a magnetic field of the magnetic device 38.

The valve 16 may close in response to at least two of the magnetic devices 38 being displaced into the valve 16.

The method can include retrieving the magnetic device 38 from the valve 16. Retrieving the magnetic device 38 may include expanding a retractable seat 56 and/or displacing the magnetic device 38 through a seat 56.

The magnetic device 38 may comprise multiple magnetic field-producing components (such as multiple magnets 68, etc.) arranged in a pattern on a sphere 76. The pattern can comprise spaced apart positions distributed along a continuous undulating path about the sphere 76.

Also described above is an injection valve 16 for use in a subterranean well. In one example, the injection valve 16 can include a sensor 40 which detects a magnetic field, and an actuator 50 which opens the injection valve 16 in response to detection of at least one predetermined magnetic signal by the sensor 40.

The actuator 50 may open the injection valve 16 in response to a predetermined number of magnetic signals being detected by the sensor 40.

The injection valve 16 can also include a retractable seat 56. The retractable seat 56 may be activated to a sealing position in response to detection of the predetermined magnetic signal by the sensor 40.

The actuator 50 may open the injection valve 16 in response to a predetermined magnetic pattern being detected by the sensor 40, and/or in response to multiple predetermined magnetic signals being detected by the sensor. At least two of the predetermined magnetic signals may be different from each other.

A method of injecting fluid 24 into selected ones of multiple zones 22*a-d* penetrated by a wellbore 14 is also described above. In one example, the method can include producing a first magnetic pattern in a tubular string 12 having multiple injection valves 16*a-e* interconnected therein, opening a first set (such as, valves 16*b,c*) of at least one of the injection valves 16*a-e* in response to the first magnetic pattern producing step, producing a second magnetic pattern in the tubular string 12, and opening a second set (such as, valve 16*a*) of at least one of the injection valves 16*a-e* in response to the second magnetic pattern producing step.

The first injection valve set 16*b,c* may open in response to the first magnetic pattern including a first predetermined number of magnetic devices 38. The second injection valve set 16*a* may open in response to the second magnetic pattern including a second predetermined number of the magnetic devices 38.

In another aspect, the above disclosure describes a method of actuating well tools in a well. In one example, the method can include producing a first magnetic pattern in the well, thereby transmitting a corresponding first magnetic signal to the well tools (such as valves 16*a-e*, etc.), and at least one of the well tools actuating in response to detection of the first magnetic signal.

The first magnetic pattern may comprise a predetermined number of the magnetic devices 38, a predetermined spacing in time of the magnetic devices 38, or a predetermined spacing in time between predetermined numbers of the magnetic devices 38, etc. Any pattern may be used in keeping with the scope of this disclosure.

A first set of the well tools may actuate in response to detection of the first magnetic signal. A second set of the well tools may actuate in response to detection of a second magnetic signal. The second magnetic signal can correspond to a second magnetic pattern produced in the well.

The well tools can comprise valves, such as injection valves 16, or other types of valves, or other types of well tools. Other types of valves can include (but are not limited to) sliding side doors, flapper valves, ball valves, gate valves, pyrotechnic valves, etc. Other types of well tools can include packers 18*a-e*, production control, conformance, fluid segregation, and other types of tools.

The method may include injecting fluid 24 outward through the injection valves 16*a-e* and into a formation 22 surrounding a wellbore 14.

The method may include detecting the first magnetic signal with a magnetic sensor 40.

The magnetic pattern can comprise a predetermined magnetic field pattern (such as, the pattern of magnetic field-producing components on the magnetic device 38 of FIGS. 7 & 8, etc.), a predetermined pattern of multiple magnetic fields (such as, a pattern produced by displacing multiple magnetic devices 38 in a certain manner through the well, etc.), a predetermined change in a magnetic field (such as, a change produced by displacing a metallic device past or to the sensor 40), and/or a predetermined pattern of multiple magnetic field changes (such as, a pattern produced by displacing multiple metallic devices in a certain manner past or to the sensor 40, etc.).

In one example, a magnetic device 38 described above can include multiple magnetic field-producing components arranged in a pattern on a sphere 76. The magnetic field-producing components may comprise permanent magnets 68.

The pattern may comprise spaced apart positions distributed along a continuous undulating path about the sphere 76.

The magnetic field-producing components may be positioned in recesses 74 formed on the sphere 76.

The actuating can be performed by piercing a pressure barrier 48.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

Figure 14A:
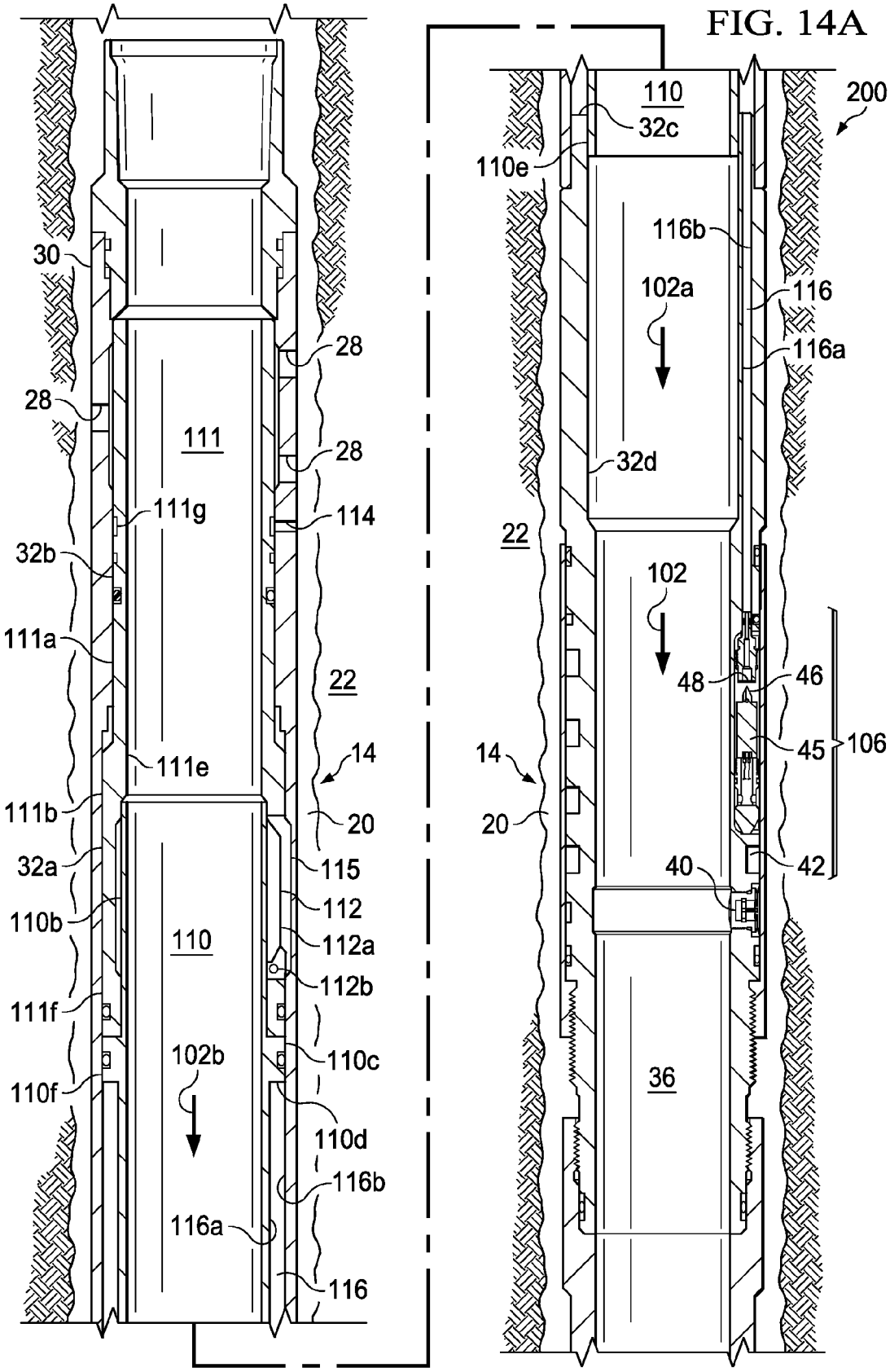
FIG. 14A is a representative cross-sectional view of a wellbore servicing tool in a first configuration.
Figure 14B:
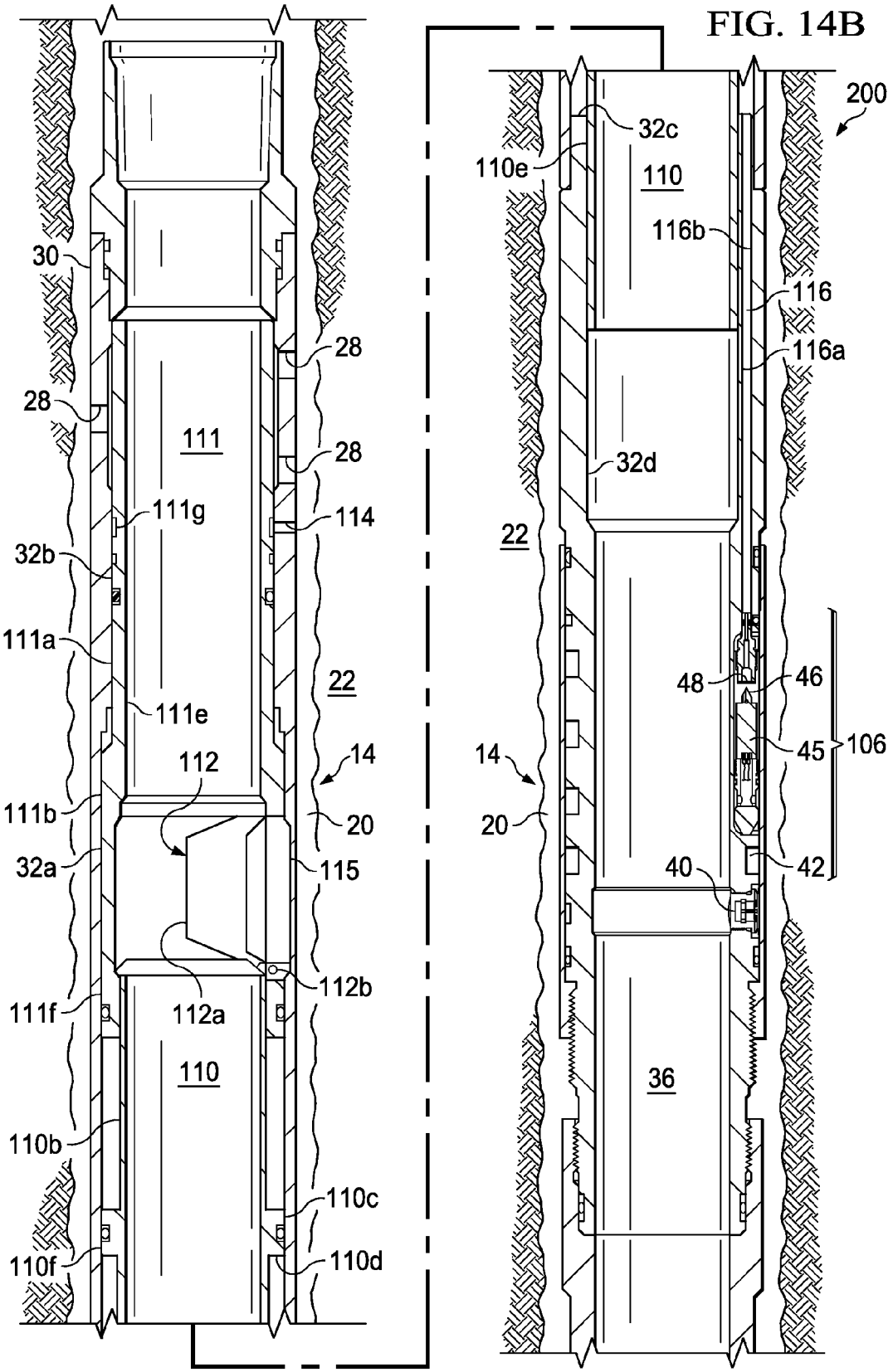
FIG. 14B is a representative cross-sectional view of a wellbore servicing tool in a second configuration.
Figure 14C:
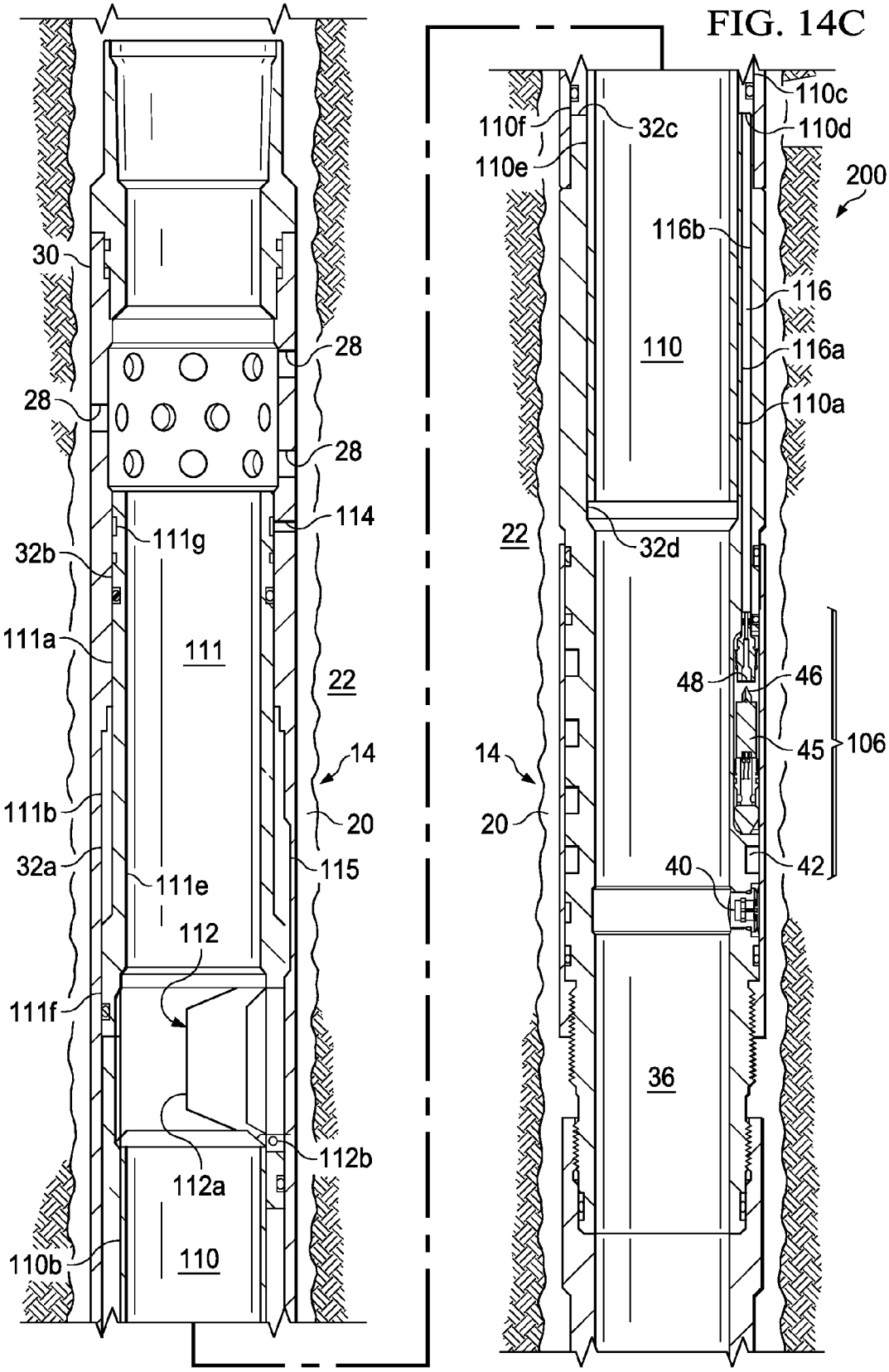
FIG. 14C is a representative cross-sectional view of a wellbore servicing tool in a third configuration.

In an embodiment, the system 10 comprises one or more valves, such as valves 16*a*-16*e*, having an alternative configuration. In such an alternative embodiment, such valves may similarly be configured so as to allow fluid to selectively be emitted therefrom, for example, in response to sensing a predetermined pressure signal. Referring to FIGS. 14A-14C, an embodiment of such an alternative valve configuration is disclosed as a well tool 200. In the embodiment of FIGS. 14A-14C, the well tool 200 may generally comprise a housing 30 generally defining a flow passage 36, a first sliding sleeve 110, a second sliding sleeve 111 comprising an activatable flapper valve 112, one or more ports 28 for fluid communication between the flow passage 36 of well tool 200 and an exterior of the tool 200 (e.g., an annular space), and a triggering system 106.

In an embodiment, the well tool 200 is selectively configurable either to allow fluid communication via the flow passage 36 in both directions or to allow fluid communication via the flow passage 36 in one direction (e.g., a first direction) and disallow fluid communication via the flow passage 36 of the tubular string 12 (e.g., a casing string) in the opposite direction (e.g., a second direction). Also, the wellbore servicing tool 200 is selectively configurable either to disallow fluid communication to/from the flow passage 36 of the well tool 200 to/from an exterior of the well tool 200 or to allow fluid communication to/from the flow passage 36 of the well tool 200 to/from an exterior of the well tool 200. Referring again to FIGS. 14A-14C, in an embodiment, the well tool 200 may be configured to be transitioned from a first configuration to a second configuration and from the second configuration to a third configuration, as will be disclosed herein.

In the embodiment depicted by FIG. 14A, the well tool 200 is illustrated in the first configuration. In the first configuration, the well tool 200 is configured to allow fluid communication in both directions via the flow passage 36 of the tubular string 12 and to disallow fluid communication from the flow passage 36 of the well tool 200 to the wellbore 14 via the ports 28. Additionally, in an embodiment, when the well tool 200 is in the first configuration, the first sliding sleeve 110 is located (e.g., immobilized) in a first position within the well tool 200, as will be disclosed herein. Also, in such an embodiment, the second sleeve 111 is located (e.g., immobilized) in a first position within the well tool 200, as will also be disclosed herein.

In an embodiment as depicted by FIG. 14B, the well tool 200 is illustrated in the second configuration. In the second configuration, the well tool 200 is configured to allow fluid communication in a first direction and disallow fluid communication in a second direction via the flow passage 36 of the wellbore servicing tool 200 and to disallow fluid communication from the flow passage 36 of the well tool 200 to an exterior of the wellbore tool 200 via the ports 28. In an embodiment as will be disclosed herein, the well tool 200 may be configured to transition from the first configuration to the second configuration upon the application of a predetermined pressure signal to the flow passage 36 of the well tool 200. Additionally, in an embodiment, when the well tool 200 is in the second configuration, the first sliding sleeve 110 may be in a second position (e.g., no longer immobilized in the first position) within the well tool 200, as will be disclosed herein. Also, in such an embodiment, when the well tool 200 is in the second configuration, the second sliding sleeve 111 is retained in its first position (e.g., immobilized) within the well tool 200, as will also be disclosed herein.

In an embodiment as depicted by FIG. 14C, the well tool 200 is illustrated in the third configuration. In the third configuration, the well tool 200 is configured to allow fluid communication in the first direction and disallow fluid communication in a second direction via the flow passage 36 of the well tool 200 and to allow fluid communication from the flow passage 36 of the well tool 200 to the wellbore 14 via the ports 28. In an embodiment, as will be disclosed herein, the well tool 200 may be configured to transition from the second configuration to the third configuration upon the application of a pressure (e.g., a fluid or hydraulic pressure) to the flow passage 36 of the well tool 200 of at least a predetermined pressure threshold. Additionally, in an embodiment, when the well tool 200 is in the third configuration the first sliding sleeve 110 is in the second position, as will be disclosed herein. Also, in such an embodiment, when the well tool 200 is in the third configuration, the second sliding sleeve 111 is in a second position, as will also be disclosed herein.

Referring to FIGS. 14A-14C, in an embodiment, the well tool 200 comprises a housing 30 which generally comprises a cylindrical or tubular-like structure. The housing 30 may comprise a unitary structure; alternatively, the housing 30 may be made up of two or more operably connected components (e.g., an upper component and a lower component). Alternatively, a housing may comprise any suitable structure; such suitable structures will be appreciated by those of skill in the art with the aid of this disclosure.

In an embodiment, the well tool 200 may be configured for incorporation into the tubular string 12 or another suitable tubular string. In such an embodiment, the housing 30 may comprise a suitable connection to the tubular string 12 (e.g., to a casing string member, such as a casing joint), or alternatively, into any suitable string (e.g., a liner, a work string, a coiled tubing string, or other tubular string). For example, the housing 30 may comprise internally or externally threaded surfaces. Additional or alternative suitable connections to a tubular string (e.g., a casing string) will be known to those of skill in the art upon viewing this disclosure.

In the embodiment of FIGS. 14A-14C, the housing 30 generally defines the flow passage 36. In such an embodiment, the well tool 200 is incorporated within the tubular string 12 such that the flow passage 36 of the well tool 200 is in fluid communication with the flow passage of the tubular string 12.

In an embodiment, the housing 30 comprises one or more ports 28. In such an embodiment, the ports 28 may extend radially outward from and/or inwards towards the flow passage 36, as illustrated in FIGS. 14A-14C. As such, these ports 28 may provide a route of fluid communication from the flow passage 36 to an exterior of the housing 30 (or vice-versa) when the well tool 200 is so-configured. For example, the well tool 200 may be configured such that the ports 28 provide a route of fluid communication between the flow passage 36 and the exterior of the well tool 200 (for example, the annulus extending between the well tool 200 and the walls of the wellbore 14 when the tool 200 is positioned within the wellbore) when the ports 28 are unblocked (e.g., by the second sliding sleeve 111, as will be disclosed herein). Alternatively, the well tool 200 may be configured such that no fluid will be communicated via the ports 28 between the flow passage 36 and the exterior of the well tool 200 when the ports are blocked (e.g., by the second sliding sleeve 111, as will be disclosed herein). In an embodiment, the ports 28 may be fitted with one or more pressure-altering devices (e.g., nozzles, erodible nozzles, fluid jets, or the like). In an additional embodiment, the ports 28 may be fitted with plugs, screens, covers, or shields, for example, to prevent debris from entering the ports 28.

In an embodiment, the housing 30 may be configured to allow the first sliding sleeve 110 and the second sliding sleeve 111 to be slidably positioned therein. For example, in an embodiment, the housing 30 generally comprises a first cylindrical bore surface 32*a*, a second cylindrical bore surface 32*b*, a first axial face 32*c*, and a third cylindrical bore surface 32*d*. In the embodiments of FIGS. 14A-14C, in such an embodiment, an upper interior portion of the housing 30 may be generally defined by the second cylindrical bore surface 32*b*. Also, in such an embodiment, the first cylindrical bore surface 32*a* may generally define an intermediate interior portion of the housing 30, for example, below the second cylindrical bore surface 32*b*. Additionally, in an embodiment, the third cylindrical bore surface 32*d* may generally define an interior portion of the housing 30 below the first cylindrical bore surface 32*a*. In an embodiment, the first axial face 32*c* may be positioned at the interface of the first cylindrical bore surface 32*a* and the third cylindrical bore surface 32*d*.

In an embodiment, the first cylindrical bore surface 32*a* may be generally characterized as having a diameter greater than the diameter of the second cylindrical bore surface 32*b*. Also, in such an embodiment, the third cylindrical bore surface 32*d* may be generally characterized as having a diameter less than the first cylindrical bore surface 32*a*.

In an embodiment, the housing 30 may further comprise one or more recesses, cut-outs, chambers, voids, or the like in which one or more components of the triggering system 106, as will be disclosed herein.

In the embodiments of FIGS. 14A-14C, the first sliding sleeve 110 and the second sliding sleeve 111 each generally comprise a cylindrical or tubular structure generally defining a flow passage extending there-though. In an embodiment, the first sliding sleeve 110 and/or the second sliding sleeve 111 may comprise a unitary structure; alternatively, the first sliding sleeve 110 and/or the second sliding sleeve 111 may be made up of two or more operably connected segments (e.g., a first segment, a second segment, etc.). Alternatively, the first sliding sleeve 110 and/or the second sliding sleeve 111 may comprise any suitable structure. Such suitable structures will be appreciated by those of skill in the art upon viewing of this disclosure.

In an embodiment, the first sliding sleeve 110 may comprise a first cylindrical outer surface 110*a*, a second cylindrical outer surface 110*b*, a third cylindrical outer surface 110*c*, and a first sleeve supporting face 110*d*. In an embodiment, the diameter of the first cylindrical outer surface 110*a* may be less than the diameter of the third cylindrical outer surface 110*c* and the diameter of the second cylindrical outer surface 110*b* may be less than the diameter of the third outer cylindrical surface 110*c*.

In an embodiment, the second sliding sleeve 111 may comprise a second sleeve first cylindrical outer face 111*a* and a second sleeve second cylindrical outer face 111*b*. In an embodiment, the diameter of the second sleeve first cylindrical outer surface 111*a* may be less than the diameter of the second sleeve second cylindrical outer surface 111*b*.

Additionally, in an embodiment the second sliding sleeve 111 comprises the activatable flapper valve 112. In an embodiment, the activatable flapper valve 112 may comprise a flap 112*a* or disk movably (e.g., rotatably) connected to the second sliding sleeve 111 via a hinge 112*b*. The flap 112*a* may be round, elliptical, or any other suitable shape. In the embodiment of FIGS. 14A-14C, the flap 112*a* comprises a substantially curved structure (e.g., a spherical cap or hemisphere). Alternatively, the flap 112*a* may be partially or substantially flat, curved, or combinations thereof. The flapper 112*a* may be constructed of any suitable materials as would be appreciated by one of skill in the art (e.g., a metal, a plastic, a composite, etc.).

In an embodiment, the flapper 112*a* may be rotatable about the hinge 112*b* from a first, unactuated position to a second, actuated position. The hinge 112*b* may comprise any suitable type or configuration. In an embodiment, in the first unactuated position, the flapper 112*a* may be configured to not impede fluid communication via the flow passage 36 and, in the second, actuated position the flapper 112*a* may be configured to impede fluid communication via the flow passage 36. In an embodiment, the flapper 112*a* may be biased, for example, biased toward the second, actuated position. The flapper 112*a* may be biased via the operation of any suitable biasing means or member, such as a spring-loaded hinge.

For example, in an embodiment, when the flapper 112*a* is in the first, unactuated position, the flapper 112*a* may be retained within a recess 115 within the second sliding sleeve 111. The recess 115 may comprise a depression (alternatively, a groove, cut-out, chamber, hollow, or the like) beneath the inner bore surface 111*e* of the second sliding sleeve 111. Also, when the flapper is in the second, actuated position, the flapper 112*a* may protrude into the flow passage 36, for example, so as to sealingly engage or rest against a portion of the inner bore surface of the second sliding sleeve 111 (alternatively, engaging a shoulder, a mating seat, the like, or combinations thereof) and thereby prohibit and/or impede fluid communication via the flow passage in a first direction (e.g., downward). For example, as will be disclosed herein, in an embodiment, the flapper 112*a* may rotate about the hinge 112*b* so as to engage a mating surface and thereby to block a downward fluid flow via the flow passage 36 or away from the mating surface so as to allow upward fluid flow via the flow passage 36. In an embodiment, the flapper 112*a* may be biased about the hinge 112*b*, for example, toward either the first, unactuated position or toward the second, actuated position.

In an embodiment, the activatable flapper valve 112, or a portion thereof, may be characterized as removable. For example, in such an embodiment, the activatable flapper valve 112 (e.g., the flapper 112*a*, the hinge 112*b*, portions thereof, or combinations thereof) may be configured for removal upon experiencing a predetermined condition. In such an embodiment, the flapper 112*a*, the hinge 112*b*, or combinations thereof may comprise a suitable degradable material. As used herein, the term "degradable material" may refer to any material capable of undergoing an irreversible degradation (e.g., a chemical reaction) so as to cause at least a portion of the component comprising the degradable material to be removed. In various embodiments, the degradable material may comprise a biodegradable material, a frangible material, an erodible material, a dissolvable material, a consumable material, a thermally degradable material, any otherwise suitable material capable of degradation (as will be disclosed herein), or combinations thereof.

For example, in an embodiment the activatable flapper valve 112 (e.g., the flapper 112*a*, the hinge 112*b*, portions thereof, or combinations thereof) may comprise any material suitable to be at least partially degraded (e.g., dissolved) for example, upon being contacted with a degrading fluid (e.g., a fluid selected and/or configured so as to effect degradation and/or removal of at least a portion of the degradable material), which may comprise a suitable chemical, while having the strength to withstand a pressure differential across the flapper valve 112 (e.g., as will be disclosed herein) prior to being contacted with such a fluid. In an embodiment, the degradable material may form a portion of the flapper valve 112 or, alternatively, the entire structure of the flapper valve 112. For example, in an embodiment the degradable material may form a portion of the flapper valve 112 so as, upon degradation, to form a fluid passage through the flapper 112*a*, to allow the flapper valve 112 to lose structural integrity (e.g., so as to fail mechanically, disintegrate, and/or break apart), to disengage the second sliding sleeve 111 (e.g., via the hinge 112*b*), or combinations thereof. For example, one or more central portions of the flapper 112*a* may comprise a degradable material that, upon degradation, forms a flow passage therethrough without the flapper 112*a* being wholly removed from the second sliding sleeve 111. Alternatively, upon degradation of the degradable portion, all or a portion the remaining flapper valve 112 may disintegrate or otherwise disperse based on a lack of structure integrity, thereby effecting the removal of the flapper valve 112 from the flow passage 36, for example, so that fluid communication via the flow passage 36 may be reestablished. In an additional or alternative embodiment, a portion of the second sliding sleeve 111 (e.g., a hinge portion of the second sliding sleeve 111 to which the flapper 112*a* is attached) may comprise a degradable material that may be degraded so as to release the flapper 112*a*.

In an embodiment, the degradable materials may comprise an acid soluble metal including, but not limited to, barium, calcium, sodium, magnesium, aluminum, manganese, zinc, chromium, iron, cobalt, nickel, tin, an alloy thereof, or combinations thereof. In an embodiment, the degradable materials may comprise a water soluble metal, for example, an aluminum alloy colloquially known as "dissolvable aluminum" and commercially available from Praxair in Danbury, Conn. In some embodiments, the degradable materials may comprise various polymers. Examples of such a polymer include, but are not limited to, a poly(lactide); a poly(glycolide); a poly(lactide-co-glycolide); a poly(lactic acid); a poly(glycolic acid); a poly(lactic acid-co-glycolic acid); poly(lactide)/poly(ethylene glycol) copolymers; a poly(glycolide)/poly(ethylene glycol) copolymer; a poly(lactide-co-glycolide)/poly(ethylene glycol) copolymer; a poly(lactic acid)/poly(ethylene glycol) copolymer; a poly(glycolic acid)/poly(ethylene glycol) copolymer; a poly(lactic acid-co-glycolic acid)/poly(ethylene glycol) copolymer; a poly(caprolactone); poly(caprolactone)/poly(ethylene glycol) copolymer; a poly(orthoester); a poly(phosphazene); a poly(hydroxybutyrate) or a copolymer including a poly(hydroxybutyrate); a poly(lactide-co-caprolactone); a polycarbonate; a polyesteramide; a polyanhidride; a poly(dioxanone); a poly(alkylene alkylate); a copolymer of polyethylene glycol and a polyorthoester; a biodegradable polyurethane; a poly(amino acid); a polyetherester; a polyacetal; a polycyanoacrylate; a poly(oxyethylene)/poly(oxypropylene) copolymer, or combinations thereof. In an embodiment, such a combination may take the form of a co-polymer and/or a physical blend. In an additional or alternative embodiment, the degradable material may comprise various soluble compounds. For example, the degradable materials may comprise a combination of sand and salt materials in a compressed state. The soluble materials may be configured to at least partially dissolve and/or hydrolyze in the presence of a suitable fluid and/or in response to one or more fluid pressure cycles. Such soluble materials are employed commercially by Halliburton Energy Services, of Houston, Tex. as the Mirage® Disappearing Plug, and may be similarly employed as a degradable material.

In some embodiments, the flapper valve 112 may comprise one or more coatings and/or layers used to isolate the degradable material from the fluid (and/or chemical) until such coating or layer is removed, thereby delaying the degradation of the flapper valve 112. In an embodiment, the coating or layer may be disposed over at least a portion of the flapper valve 112 which is exposed to fluid. The coating or layer can be designed to disperse, dissolve, or otherwise permit contact between the flapper valve 112 and the fluid when desired. The coating may comprise a paint, organic and/or inorganic polymers, oxidic coating, graphitic coating, elastomers, or any combination thereof which disperses, swells, dissolves and/or otherwise degrades either thermally, photo-chemically, bio-chemically and/or chemically, when contacted with a suitable stimulus, such as external heat and/or a solvent (such as aliphatic, cycloaliphatic, and/or aromatic hydrocarbons, etc.). For example, in an embodiment the coating or layer may comprise a degradable material (e.g., which is a different degradable material from the degradable material which it covers or conceals). In an embodiment, the coating or layer may be configured to disperse, dissolve, or otherwise be removed upon contact with a fluid (e.g., a chemical) that is different from the fluid used to degrade the degradable material.

In an embodiment, any fluid comprising a suitable chemical capable of dissolving at least a portion of the degradable material(s), for example, as disclosed herein, may be used. In an embodiment, the chemical may comprise an acid, an acid generating component, a base, a base generating component, and any combination thereof. Examples of acids that may be suitable for use in the present invention include, but are not limited to organic acids (e.g., formic acids, acetic acids, carbonic acids, citric acids, glycolic acids, lactic acids, ethylenediaminetetraacetic acid (EDTA), hydroxyethyl ethylenediamine triacetic acid (HEDTA), and the like), inorganic acids (e.g., hydrochloric acid, hydrofluoric acid, nitric acid, sulfuric acid, phosphonic acid, p-toluenesulfonic acid, and the like), and combinations thereof. Examples of acid generating compounds may include, but are not limited to, polyamines, polyamides, polyesters, and the like that are capable of hydrolyzing or otherwise degrading to produce one or more acids in solution (e.g., a carboxylic acid, etc.). Examples of suitable bases may include, but are not limited to, sodium hydroxide, potassium carbonate, potassium hydroxide, sodium carbonate, and sodium bicarbonate. In some embodiments, additional suitable chemicals can include a chelating agent, an oxidizer, or any combination thereof. Alternatively, in an embodiment, the fluid may comprise water or a substantially aqueous fluid. One of ordinary skill in the art with the benefit of this disclosure will recognize the suitability of the chemical used with the fluid to degrade (e.g., dissolve) at least a portion of the degradable material based on the composition of the degradable material and the conditions within the wellbore.

In an embodiment, the selection of the materials for the degradable portion of the flapper valve 112, the chemical intended to at least partially degrade the degradable material, and the optional inclusion of any coating may be used to determine the rate at which the flapper valve 112, or some component or portion thereof, degrades. Further factors affecting the rate of degradation include the characteristics of the wellbore environment including, temperature, pressure, flow characteristics around the plug, and the concentration of the chemical in the fluid in contact with the degradable material. These factors may be manipulated to provide a desired time delay before the flapper valve is degraded sufficiently as to permit fluid communication via the flow passage 36.

In an embodiment, the first sliding sleeve 110 and the second sliding sleeve 111 may each be slidably positioned within the housing 30. For example, in the embodiment of FIGS. 14A-14C, at least a portion of the first cylindrical outer surface 110*a* may be slidably fitted against at least a portion of the third cylindrical bore surface 32*d* of the housing 30 in a fluid-tight or substantially fluid-tight manner. Additionally, in such an embodiment, the third cylindrical outer surface 110*c* may be slidably fitted against at least a portion of the first cylindrical bore surface 32*a* of the housing 30 in a fluid-tight or substantially fluid-tight manner. For example, in an embodiment, the first sliding sleeve 110 may further comprise one or more suitable seals (e.g., O-ring, T-seal, gasket, etc.) at one or more surface interfaces, for example, for the purposes of prohibiting or restricting fluid movement via such a surface interface. In the embodiment of FIGS. 14A-14C, the first sliding sleeve 110 comprises seals 110*e* at the interface between the first cylindrical outer surface 110*a* and the third cylindrical bore surface 32*d* and seals 110*f* at the interface between the third cylindrical outer surface 110*c* and the first cylindrical bore surface 32*a*.

Also, in the embodiments of FIGS. 14A-14C, the second sleeve first bore face 111*a* may be slidably fitted against the second cylindrical bore surface 32*b* of the housing 30 in a fluid-tight or substantially fluid-tight manner. Also, in such an embodiment, the second sleeve second bore face 111*b* may be slidably fitted against the first cylindrical bore surface 32*a* of the housing 30 in a fluid-tight or substantially fluid-tight manner. In an embodiment, the second sliding sleeve 111 may further comprise one or more suitable seals (e.g., O-ring, T-seal, gasket, etc.) at one or more surface interfaces, for example, for the purposes of prohibiting or restricting fluid movement via such a surface interface. In the embodiment of FIGS. 14A-14C, the second sliding sleeve 111 comprises a seal 111*f* at the interface between the second sleeve first bore face 111*a* and the second cylindrical bore surface 32*b* and a seal 111*g* at the interface between the second sleeve second bore face 111*b* and the first cylindrical bore surface 32*a*.

Also, in an embodiment, at least a portion of the first sliding sleeve 110 may be slidably positioned within (e.g., within the inner bore surface) of the second sliding sleeve 111. For example, in such an embodiment, the second cylindrical bore surface 110*b* of the first sliding sleeve 110 may be sized to fit within the inner bore surface 111*e* of the second sliding sleeve 111. In the embodiment of FIGS. 14A-14C, at least a portion of the second cylindrical bore 110*b* may be slidably fitted against at least a portion of the inner bore surface 111*e* of the second sliding sleeve 111.

In an embodiment, an atmospheric chamber 116 is generally defined by a first sleeve supporting face 110*d* of the first sliding sleeve 110, a destructible member 48, a first chamber surface 116*a* comprising an inner cylindrical surface extending from the destructible member 48 in the direction of the first sleeve supporting face 110*d*, and a second chamber surface 116*b* comprising an inner cylindrical surface extending from the destructible member 48 in the direction the first sleeve supporting face 110*d*, as illustrated in FIGS. 14A-14C.

In an embodiment, the atmospheric chamber 116 may be characterized as having a variable volume. For example, volume of the atmospheric chamber 116 may vary with movement of the first sliding sleeve 110, as will be disclosed herein.

In an embodiment, both the first sliding sleeve 110 and the second sliding sleeve 111 may be movable, with respect to the housing 30, from a first position to a second position, respectively. In an embodiment, the direction or directions in which fluid communication is allowed via the flow passage 36 of the well tool 200 may depend upon the position of the first sliding sleeve 100 relative to the housing 30. Additionally, fluid communication between the flow passage 36 of the well tool 200 and the exterior of the well tool 200, for example, via the ports 28, may depend upon the position of the second sliding sleeve 111 relative to the housing 30.

Referring to the embodiment of FIG. 14A, the first sliding sleeve 110 is illustrated in the first position. In the first position, the second cylindrical outer surface 110*b* of the first sliding sleeve 110 maintains the flapper 112*a* within the recess 115 of the second sliding sleeve 111 and thereby, allows fluid communication in both directions (e.g., bidirectional flow) via the flow passage 36. For example, when the first sliding sleeve 110 is in the first position, at least a portion of the second cylindrical outer surface 110*b* extends over at least a portion of the flapper 112*a*, thereby retaining the flapper 112*a* in its first, unactuated position (in which the flapper does not protrude into the flow passage 36).

Referring to the embodiment of FIGS. 14A-14B, the second sliding sleeve is illustrated in the first position. In the first position, the second sliding sleeve 111 blocks the ports 28 of the housing 30 and thereby, prevents fluid communication between the flow passage 36 of the well tool 200 the exterior of the well tool 200 via the ports 28.

Referring to the embodiment of FIGS. 14B-14C, the first sliding sleeve is illustrated in the second position. In the second position, the first sliding sleeve 110 does not (i.e., no longer) retains the activatable flapper valve 112 within the recessed chamber 115 of the second sleeve 111. In such an embodiment, the activatable flapper valve 112 is free to rotate about the hinge so as to protrude into the flow passage 36, for example, so as to engage a mating seat, and thereby block the flow passage 36 of the housing 30 to prevent fluid communication (e.g., downward fluid communication) therethrough. With the flapper 112*a* protruding or extending into the flow passage, the flapper 112*a* is free to open (for example, so as to allow upward fluid communication via the flow passage 36) or to close (for example, so as to impede or prohibit downward fluid communication via the flow passage 36), thereby allowing for fluid communication in only one direction (e.g., unidirectional flow).

Referring to FIG. 14C, the second sliding sleeve 111 is illustrated in the second position. In the second position, the second sliding sleeve 111 does not block the ports 28 of the housing 30 and thereby, allows fluid communication from the flow passage 36 of the well tool 200 to the exterior of the well tool 200 via the ports 28. For example, in the embodiment of FIG. 14C, the first sliding sleeve is in the second position and the second sliding sleeve 111 is also the second position.

In an embodiment, both the first sliding sleeve 110 and the second sliding sleeve 111 may be configured to be selectively transitioned from the first position to the second position. Additionally, in an embodiment, the first sliding sleeve 110, the second sliding sleeve 111, or both may be held (e.g., selectively retained) in the first position by a suitable retaining mechanism.

In an embodiment the first sliding sleeve 110 may be configured to transition from the first position to the second position following the activation of the triggering system 106. For example, in an embodiment, upon activating the triggering system 106 a pressure change within the atmospheric chamber 116 may result in a differential force applied to the first sliding sleeve 110 in the direction towards the second position, as will be disclosed herein.

For example, in the embodiment of FIGS. 14A-14C, the first sliding sleeve 110 may be held (e.g., selectively retained) in the first position by a hydraulic fluid which may be selectively retained within the atmospheric chamber 116 by the triggering system 106, as will be discussed herein. In such an embodiment, while the hydraulic fluid is retained the within the atmospheric chamber 116, the first sliding sleeve 110 may be impeded from moving in the direction of the second position. Conversely, while the hydraulic fluid is not retained within the atmospheric chamber 116, the first sliding sleeve 110 may be allowed to move in the direction of the second position. In an embodiment, the hydraulic fluid may comprise any suitable fluid. In an embodiment, the hydraulic fluid may be characterized as having a suitable rheology. In an embodiment, the atmospheric chamber 116 is filled or substantially filled with a hydraulic fluid that may be characterized as a compressible fluid, for example a fluid having a relatively low compressibility, alternatively, the hydraulic fluid may be characterized as substantially incompressible. In an embodiment, the hydraulic fluid may be characterized as having a suitable bulk modulus, for example, a relatively high bulk modulus. For example, in an embodiment, the hydraulic fluid may be characterized as having a bulk modulus in the range of from about 1.8 $10^5$ psi, $lb_f/in^2$ to about 2.8 $10^5$ psi, $lb_f/in^2$ from about 1.9 $10^5$ psi, $lb_f/in^2$ to about 2.6 $10^5$ psi, $lb_f/in^2$, alternatively, from about 2.0 $10^5$ psi, $lb_f/in^2$ to about 2.4 $10^5$ psi, $lb_f/in^2$. In an additional embodiment, the hydraulic fluid may be characterized as having a relatively low coefficient of thermal expansion. For example, in an embodiment, the hydraulic fluid may be characterized as having a coefficient of thermal expansion in the range of from about 0.0004 cc/cc/° C. to about 0.0015 cc/cc/° C., alternatively, from about 0.0006 cc/cc/° C. to about 0.0013 cc/cc/° C., alternatively, from about 0.0007 cc/cc/° C. to about 0.0011 cc/cc/° C. In another additional embodiment, the hydraulic fluid may be characterized as having a stable fluid viscosity across a relatively wide temperature range (e.g., a working range), for example, across a temperature range from about 50° F. to about 400° F., alternatively, from about 60° F. to about 350° F., alternatively, from about 70° F. to about 300° F. In another embodiment, the hydraulic fluid may be characterized as having a viscosity in the range of from about 50 centistokes to about 500 centistokes. Examples of a suitable hydraulic fluid include, but are not limited to oils, such as synthetic fluids, hydrocarbons, or combinations thereof. Particular examples of a suitable hydraulic fluid include silicon oil, paraffin oil, petroleum-based oils, brake fluid (glycol-ether-based fluids, mineral-based oils, and/or silicon-based fluids), transmission fluid, synthetic fluids, or combinations thereof.

In an embodiment, for example, in the embodiments illustrated by FIGS. 14A-14C, where fluid is not retained within the atmospheric chamber 116, the first sliding sleeve 110 may be configured to transition from the first position to the second position upon the application of a hydraulic pressure to the flow passage 36. In such an embodiment, the first sliding sleeve 110 may comprise a differential in the surface area of the upward-facing surfaces which are fluidicly exposed to the flow passage 36 and the surface area of the downward-facing surfaces which are fluidicly exposed to the flow passage 36. For example, in an embodiment, the exposed surface area of the surfaces of the first sliding sleeve 36 which will apply a force (e.g., a hydraulic force) in the direction toward the second position (e.g., a downward force) may be greater than exposed surface area of the surfaces of the first sliding sleeve 110 which will apply a force (e.g., a hydraulic force) in the direction away from the second position (e.g., an upward force). For example, in the embodiment of FIGS. 14A-14C and not intending to be bound by theory, the atmospheric chamber 116 is fluidicly sealed (e.g., by fluid seals 110*e* and 110*f*), and therefore unexposed to hydraulic fluid pressures applied to the flow passage, thereby resulting in such a differential in the force applied to the first sliding sleeve 110 in the direction toward the second position (e.g., an downward force) and the force applied to the first sliding sleeve 110 in the direction away from the second position (e.g., an upward force). In an additional or alternative embodiment, a well tool like well tool 200 may further comprise one or more additional chambers (e.g., similar to atmospheric chamber 116) providing such a differential in the force applied to the first sliding sleeve in the direction toward the second position and the force applied to the sliding sleeve in the direction away from the second position. Alternatively, in an embodiment the first sliding sleeve may be configured to move in the direction of the second position via a biasing member, such as a spring or compressed fluid or via a control line or signal line (e.g., a hydraulic control line/conduit) connected to the surface.

Also, in an embodiment, (after the first sliding sleeve 110 has been transitioned from the first position to the second position, thereby allowing the flapper valve 112 to be activated, for example, as disclosed herein) the second sliding sleeve 111 may be configured to transition from the first position to the second position upon, for example, an application of hydraulic fluid pressure to the flow passage 36 of the well tool 200. For example, in an embodiment, following the transition of the first sleeve 110 to the second position, the application of a hydraulic fluid pressure to the flow passage 36 of the well tool 200 (e.g., and also to the activatable flapper valve 112 of the second sliding sleeve 111) may apply a force (e.g., a downward force) to the second sliding sleeve 111 in the direction of the second position.

Also, in an embodiment, the second sliding sleeve 111 may be held in the first position by one or more shear pins 114. In such an embodiment, the shear pins 114 may extend between the housing 30 and the second sliding sleeve 111. The shear pin 114 may be inserted or positioned within a suitable borehole in the housing 30 and the second sliding sleeve 111. As will be appreciated by one of skill in the art, the shear pin may be sized to shear or break upon the application of a desired magnitude of force for example, a force from the application of a hydraulic fluid to the activatable flapper valve 112 of the second sliding sleeve 111, as will be disclosed herein. Also, in an embodiment, the second sliding sleeve may be held in the first position by the first sliding sleeve 110 when the first sliding sleeve is in the respective first position. For example, when the first sliding sleeve 110 is in the first position, the first sliding sleeve 110 may abut the second sliding sleeve 111 and thereby inhibit the second sliding sleeve 111 from movement from the first position in the direction of the second position.

In an embodiment, the triggering system 106 may be configured to selectively allow the hydraulic fluid to be released from the atmospheric chamber. For example, the triggering system 106 may be actuated upon the application of a predetermined pressure signal to the flow passage 36 of the well tool 200, for example, via the tubular string 12.

Figure 15:
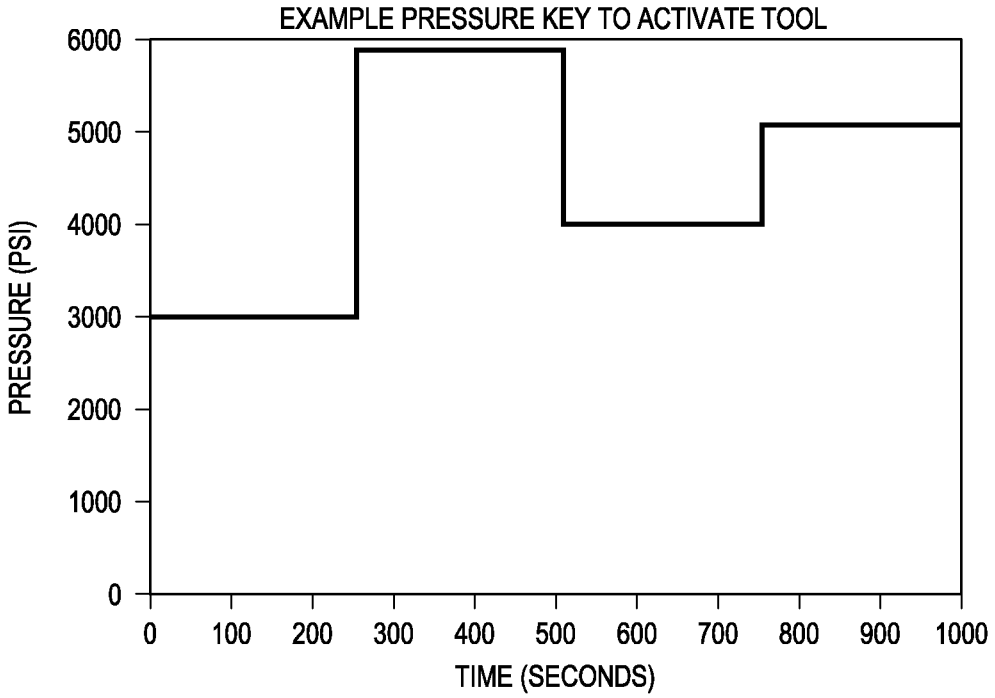
FIG. 15 is a graphical representation of an embodiment of a pressure signal.

In an embodiment, such a pressure signal (denoted by flow arrow 102 in FIG. 14A) may be generated proximate to a wellhead (e.g., via one or more pumps related surface equipments) and may be applied within the flow passage 36 of the well tool 200 via any suitable method as would be appreciated by one of skill in the art, for example, from the surface via pulse telemetry. In an alternative embodiment, the pressure signal 102 may be generated by a pump tool or other apparatus proximate to the wellhead and applied within the flow passage 36 of the well tool 200. In still another alternative embodiment, the pressure signal 102 may be generated by a tool or other apparatus disposed within the wellbore 14, within the tubular string 12, or combinations thereof. An example of a suitable pressure signal is illustrated in FIG. 15.

As used herein, the term "pressure signal" refers to an identifiable function of pressure (for example, with respect to time) as may be applied to the flow passage (such as flow passage 36) of a well tool (such as well tool 200) so as to be detected by the well tool or a component thereof. As will be disclosed herein, the pressure signal may be effective to elicit a response from the well tool, such as to "wake" one or more components of the triggering system 106, to actuate the triggering system 106 as will be disclosed herein, or combinations thereof. In an embodiment, the pressure signal 102 may be characterizing as comprising of any suitable type or configuration of waveform or combination of waveforms, having any suitable characteristics or combinations of characteristics. For example, the pressure signal 102 may be comprise a pulse width modulated signal, a signal varying pressure threshold values, a ramping signal, a sine waveform signal, a square waveform signal, a triangle waveform signal, a sawtooth waveform signal, the like, or combinations thereof. Further, the waveform may exhibit any suitable duty-cycle, frequency, amplitude, duration, or combinations thereof. For example, in an embodiment, the pressure signal 102 may comprise a sequence of one or more predetermined pressure threshold values, a predetermined discrete pressure threshold value, a predetermined series of ramping signals, a predetermined pulse width modulated signal, any other suitable waveform as would be appreciated by one of skill in the art, or combinations thereof. For example, in an embodiment, the pressure signal 102 may comprise a pulse width modulated signal with a duty cycle of from about 20% to about 30%, alternatively, about 25%, and frequency of form about 20 Hz to about 40 Hz, alternatively, about 30 Hz. In an alternative embodiment, the pressure signal 102 may comprise a sawtooth waveform with a frequency of from about 10 Hz to about 40 Hz, alternatively, about 20 Hz, with an amplitude of from about 500 p.s.i. to about 15,000 p.s.i., alternatively, about 10,000 p.s.i. An example of a suitable pressure signal is illustrated in FIG. 15. In the embodiment of FIG. 15, the pressure varies, for example, in a predetermined manner, with respect to time.

Additionally or alternatively, in an embodiment, the pressure signal 102 may comprise a series of consecutive component pressure signals (e.g., a first component pressure signal followed by a second component pressure signal, as denoted by flow arrows 102*a* and 102*b*, respectively). In an embodiment, such a series of consecutive component pressure signals may be arranged such that consecutive component pressure signals are different (e.g., the first component pressure signal 102*a* is different from the second component pressure signal 102*b*); alternatively, the series of consecutive component pressure signals may be arranged such that consecutive component pressure signals are the same (e.g., the first component pressure signal 102*a* is the same as the second component pressure signal 102*b*), for example, a signal may be repeated. For example, in an embodiment, the first component pressure signal may comprise a pulse width modulated signal with a duty cycle of about 10% and the second component pressure signal may comprise a pulse width modulated signal with a duty cycle of 50%. In an alternative embodiment, the first component pressure signal may comprise a ramping waveform to a first pressure threshold and the second component pressure signal may comprise a sine wave function oscillating about the first pressure threshold at a fixed frequency. In an additional or alternative embodiment, the pressure signal 102 may comprise any suitable combination or pattern of component pressure signals.

In an alternative embodiment, the pressure signal 102 may comprise a pattern, for example, three component pressure signals may be transmitted within three minutes of each other followed by no pressure signals being transmitted for the next three minutes. In an alternative embodiment, any suitable pattern may be used as would be appreciated by one of skill in the art upon viewing the present disclosure.

In another alternative embodiment, as an alternative to the pressure signal, triggering system 106 may be actuated upon the application of another predetermined signal. For example, such a predetermined signal may comprise any suitable signal as may be detected by the triggering system 106. Such an alternative signal may comprise a flow-rate signal, a pH signal, a temperature signal, an acoustic signal, a vibrational signal, or combinations thereof. In an embodiment, such a predetermined signal may be induced within an area proximate to the well tool 200 and/or communicated to the well tool 200, for example, so as to be detectable by the triggering system 106.

In an embodiment, the triggering system 106 generally comprises a pressure sensor 40, an actuating member 45 (such as the piercing member 46, disclosed herein), and an electronic circuit 42, as illustrated in FIGS. 14A-14C and as also illustrated with respect to FIG. 11. In an embodiment, the pressure sensor 40 the electronic circuit 42, the actuating member 45, or combinations thereof may be fully or partially incorporated within the well tool 200 by any suitable means as would be appreciated by one of skill in the art. For example, in an embodiment, the pressure sensor 40, the electronic circuit 42, the actuating member 45, or combinations thereof, may be housed, individually or separately, within a recess within the housing 30 of the well tool 200. In an alternative embodiment, as will be appreciated by one of skill in the art, at least a portion of the pressure sensor 40, the electronic circuit 42, the actuating member 45, or combinations thereof may be otherwise positioned, for example, external to the housing 30 of the well tool 200. It is noted that the scope of this disclosure is not limited to any particular configuration, position, and/or number of the pressure sensors 40, electronic circuits 42, and/or actuating members 45. For example, although the embodiment of FIGS. 14A-14C illustrates a triggering system 106 comprising multiple distributed components (e.g., a single pressure sensor 40, a single electronic circuit 42, and a single actuating member 45, each of which comprises a separate, distinct component), in an alternative embodiment, a similar triggering system may comprise similar components in a single, unitary component; alternatively, the functions performed by these components (e.g., the pressure sensor 40, the electronic circuit 42, and the actuating member 45) may be distributed across any suitable number and/or configuration of like componentry, as will be appreciated by one of skill in the art with the aid of this disclosure.

In an embodiment (for example, in the embodiment of FIGS. 14A-14C where the pressure sensor 40, the electronic circuit 42, and the actuating member 45 comprise distributed components) the electronic circuit 42 may communicate with the pressure sensor 40 and/or the actuating member 45 via a suitable signal conduit, for example, via one or more suitable wires. Examples of suitable wires include, but are not limited to, insulated solid core copper wires, insulated stranded copper wires, unshielded twisted pairs, fiber optic cables, coaxial cables, any other suitable wires as would be appreciated by one of skill in the art, or combinations thereof.

In an embodiment, the electronic circuit 42 may communicate with the pressure sensor 40 and/or the actuating member 45 via a suitable signaling protocol. Examples of such a signaling protocol include, but are not limited to, an encoded digital signal.

In an embodiment, the pressure sensor 40 may comprise any suitable type and/or configuration of apparatus capable of detecting the pressure within the flow passage 36 of the well tool 200, for example, so as to detect the presence of a predetermined pressure signal, for example, as disclosed herein. Suitable sensors may include, but are not limited to, capacitive sensors, piezoresistive strain gauge sensors, electromagnetic sensors, piezoelectric sensors, optical sensors, or combinations thereof.

In an embodiment, the pressure sensor 40 may be configured to output a suitable indication of the detected pressure. For example, in an embodiment, the pressure sensor 40 may be configured to convert the detected pressure to a suitable electronic signal. In an embodiment, the suitable electronic signal may comprise a varying analog voltage or current signal proportional to a measured force applied to the pressure sensor 40. In an alternative embodiment, the suitable electronic signal may comprise a digital encoded voltage signal in response to a measured force applied to the pressure sensor 40. For example, in an embodiment, the pressure sensor 40 may detect the amount of strain on a force collector due to an applied pressure and output an indication of the applied pressure as an electronic signal. In an alternative embodiment, the pressure sensor 40 may comprise an inductive sensor, for example, configured to detect a variations in inductance and/or in an inductive coupling of a moving core due to the applied pressure within a linear variable differential transformer, and to output an electronic signal. In another alternative embodiment, the pressure sensor 40 may comprise a piezoelectric member configured to stresses, due to an applied pressure, into an electric potential. In an alternative embodiment, the pressure sensor 40 may comprise any other suitable sensor as would be appreciated by one of skill in the arts. Additionally, in an embodiment the pressure sensor 40 may further comprise an amplifier as an electrical interface and/or another other suitable internal components, as would be appreciated by one of skill in the arts.

In an embodiment, the pressure sensor 40 may be positioned within the housing 30 of the well tool 200 such that the pressure sensor 40 may sense the pressure (e.g., pressure signal 102) within the flow passage 36 of the housing 30. In an additional or alternative embodiment, the triggering system 106 may comprise two or more pressure sensors 40.

In an alternative embodiment, the triggering system 106 may comprise, as an alternative to the pressure sensor 40, a flow sensor, a pH sensor, a temperature sensor, an acoustic sensor, a vibrational sensor, or any other sensor suitable for and/or configured to detect a given predetermined signal, for example a predetermined signal as may be induced in an area proximate to and/or communicated to, a well tool like well tool 200. Examples of a predetermined signal as such a sensor and/or sensing unit may be configured to detect include, but are not limited to, those predetermined signals as have been disclosed herein.

In an embodiment, the electronic circuit 42 may be generally configured to receive a signal from the pressure sensor 40 (alternatively, other sensor), for example, so as to determine if the pressures (alternatively, other condition) detected by the pressure sensor 40 are indicative of the predetermined pressure signal (alternatively, other predetermined signal), and, upon a determination that the pressure sensor 40 has experienced the predetermined pressure signal, to output an actuating signal to the actuating member 45. In such an embodiment, the electronic circuit may be in signal communication with the pressure sensor 40 and/or the actuating member 45. In an embodiment, the electronic circuit 42 may comprise any suitable configuration, for example, comprising one or more printed circuit boards, one or more integrated circuits, a one or more discrete circuit components, one or more microprocessors, one or more microcontrollers, one or more wires, an electromechanical interface, a power supply and/or any combination thereof. As noted above, the electronic circuit 42 may comprise a single, unitary, or non-distributed component capable of performing the function disclosed herein; alternatively, the electronic circuit 42 may comprise a plurality of distributed components capable of performing the functions disclosed herein.

In an embodiment, the electronic circuit 42 may be supplied with electrical power via a power source. For example, in such an embodiment, the well tool 200 may further comprise an on-board battery, a power generation device, or combinations thereof. In such an embodiment, the power source and/or power generation device may supply power to the electric circuit 42, to the pressure sensor 40, to the actuating member, or combinations thereof, for example, for the purpose of operating the electric circuit 42, to the pressure sensor 40, to the actuating member, or combinations thereof. In an embodiment, such a power generation device may comprise a generator, such as a turbo-generator configured to convert fluid movement into electrical power; alternatively, a thermoelectric generator, which may be configured to convert differences in temperature into electrical power. In such embodiments, such a power generation device may be carried with, attached, incorporated within or otherwise suitable coupled to the well tool and/or a component thereof. Suitable power generation devices, such as a turbo-generator and a thermoelectric generator are disclosed in U.S. Pat. No. 8,162,050 to Roddy, et al., which is incorporated herein by reference in its entirety. An example of a power source and/or a power generation device is a Galvanic Cell. In an embodiment, the power source and/or power generation device may be sufficient to power the electric circuit 42, to the pressure sensor 40, to the actuating member, or combinations thereof. For example, the power source and/or power generation device may supply power in the range of from about 0.5 to about 10 watts, alternatively, from about 0.5 to about 1.0 watt.

In an embodiment, the electronic circuit 42 may be configured to sample the electronic signal from the pressure sensor 40, for example, at a suitable rate. For example, in an embodiment, the electronic circuit 42 sample rate may be about 100 Hz, alternatively, about 1 KHz, alternatively, about 10 Khz, alternatively, about 100 KHz, alternatively, about 1 MHz, alternatively, any suitable sample rate as would be appreciated by one of skill in the art.

In an embodiment, the electronic circuit 42 may be configured to determine the presence of the predetermined pressure signal 102. For example, in an embodiment, the electronic circuit 42 may comprise a microprocessor configured to decode and/or to analyze the electronic signal from the pressure sensor 40 to determine the presence of the predetermined pressure signal 102, for example, based upon the signal indicative of the pressure received from the sensor 40. In an alternative embodiment, the electronic circuit 42 may comprise one or more integrated circuits configured to compare the electronic signal from the pressure sensor 40 to predetermined electrical voltage threshold values used to determine the presence of the predetermined pressure signal 102. In an alternative embodiment, the electronic circuit 42 may comprise a capacitor or capacitor array, for example, configured to use the capacitance coupling between the capacitor or capacitor array and a capacitance of the pressure sensor 40 to determine the presence of the predetermined pressure signal 102. In an alternative embodiment, the electronic circuit 42 may comprise an electromechanical interface, for example, a wiper arm mechanically linked to a Bourdon or bellows element, such that in the presence of the pressure signal 102 the wiper arm may deflect across a potentiometer, wherein the deflection may be converted into a resistance or voltage measurement that may be measured, for example, using a Wheatstone bridge. In an embodiment, the electronic circuit 42 may comprise any suitable component and/or may employ any suitable methods to determine the presence of the predetermined pressure signal 102, as would be appreciated by one of skill in the art.

In an embodiment, the electronic circuit 42 may be configured to output a digital voltage or current signal to an actuating member 45 in response to the presence of the predetermined pressure signal 102, as will be disclosed herein. For example, in an embodiment, the electronic circuit 42 may be configured to transition its output from a low voltage signal (e.g., about 0V) to a high voltage signal (e.g., about 5V) in response to the presence of the predetermined pressure signal 102. In an alternative embodiment, the electronic circuit 42 may be configured to transition its output from a high voltage signal (e.g., about 5V) to a low voltage signal (e.g., about 0V) in response to the presence of the predetermined pressure signal 102.

Additionally, in an embodiment, the electronic circuit 42 may be configured to operate in either a low-power consumption or "sleep" mode or, alternatively, in an operational or active mode. The electronic circuit 42 may be configured to enter the active mode (e.g., to "wake") in response to a predetermined pressure signals, for example, as disclosed herein. This method can help prevent extraneous pressure fluctuations from being misidentified as an operative pressure signal.

In an embodiment, the actuating member may generally be configured to allow fluid to be selectively emitted or expelled from the atmospheric chamber 116. In an embodiment, at least a portion of the actuating member 45 may be positioned proximate to the atmospheric chamber 116. For example, in the embodiment of FIGS. 14A-14C, the triggering system 106 and the atmospheric chamber 116 share a common interface, for example, the destructible member 48.

In the embodiment of FIGS. 14A-14C, and as shown in FIG. 11, the actuating member 45 comprises a piercing member 46 such as a punch or needle. In such an embodiment, the punch may be configured, when activated, to puncture, perforate, rupture, pierce, destroy, disintegrate, combust, or otherwise cause the destructible member 48 to cease to enclose the atmospheric chamber 116. In such an embodiment, the punch may be electrically driven, for example, via an electrically-driven motor or an electromagnet. Alternatively, the punch may be propelled or driven via a hydraulic means, a mechanical means (such as a spring or threaded rod), a chemical reaction, an explosion, or any other suitable means of propulsion, in response to receipt of an activating signal. Suitable types and/or configuration of actuating members 46 are described in U.S. patent application Ser. Nos. 12/688,058 and 12/353,664, the entire disclosures of which are incorporated herein by this reference, and may be similarly employed. In an alternative embodiment, the actuating member may be configured to cause combustion of the destructible member. For example, the destructible member may comprise a combustible material (e.g., thermite) that, when detonated or ignited may burn a hole in the destructible member 48. In an embodiment, the actuating member 45 (e.g., the piercing member 46) may comprise a flow path (e.g., ported, slotted, surface channels, etc.) to allow hydraulic fluid to readily pass therethrough. In an embodiment, the actuating member 45 comprises a flow path having a metering device of the type disclosed herein (e.g., a fluidic diode) disposed therein. In an embodiment, the actuating member 45 comprises ports that flow into the fluidic diode, for example, integrated internally within the body of the actuating member 45 (e.g., the punch).

In an embodiment, the destructible member 48 may be configured to contain the hydraulic fluid within the atmospheric chamber 116 until a triggering event occurs, as disclosed herein. For example, in an embodiment, the destructible member 48 may be configured to be punctured, perforated, ruptured, pierced, destroyed, disintegrated, combusted, or the like, for example, when subjected to a desired force or pressure. In an embodiment, the destructible member 48 may comprise a rupture disk, a rupture plate, or the like, which may be formed from a suitable material. Examples of such a suitable material may include, but are not limited to, a metal, a ceramic, a glass, a plastic, a composite, or combinations thereof.

In an embodiment, upon destruction of the destructible member 48 (e.g., open), the hydraulic fluid within atmospheric chamber 116 may be free to move out of the atmospheric chamber 116 via the pathway previously contained/obstructed by the destructible member 48. For example, in the embodiment of FIGS. 14A-14C, upon destruction of the destructible member 48, the atmospheric chamber 116 may be configured such that the hydraulic fluid may be free to flow out of the atmospheric chamber 116 and into the recess housing the triggering system 106. In alternative embodiments, the atmospheric chamber 116 may be configured such that the hydraulic fluid flows into a secondary chamber (e.g., an expansion chamber), out of the well tool (e.g., into the wellbore), into the flow passage, or combinations thereof. Additionally or alternatively, the atmospheric chamber 116 may be configured to allow the fluid to flow therefrom at a predetermined or controlled rate. For example, in such an embodiment, the atmospheric chamber may further comprise a fluid meter, a fluidic diode, a fluidic restrictor, or the like. For example, in such an embodiment, the hydraulic fluid may be emitted from the atmospheric chamber via a fluid aperture, for example, a fluid aperture which may comprise or be fitted with a fluid pressure and/or fluid flow-rate altering device, such as a nozzle or a metering device such as a fluidic diode. In an embodiment, such a fluid aperture may be sized to allow a given flow-rate of fluid, and thereby provide a desired opening time or delay associated with flow of hydraulic fluid exiting the atmospheric chamber and, as such, the movement of the first sliding sleeve 110. Suitable fluid flow-rate control devices are commercially available from The Lee Company of Westbrook, Conn. and include, but are not limited to, a precision microhydraulics fluid restrictor or micro-dispensing valve or fluid jets such as the JEVA1835424H or the JEVA1835385H. Fluid flow-rate control devices and methods of utilizing the same are disclosed in U.S. patent application Ser. No. 12/539,392, which is incorporated herein in its entirety by this reference.

In an alternative embodiment, the actuating member 45 may comprise an activatable valve. In such an embodiment, the valve may be integrated within the housing (for example, at least partially defining the atmospheric chamber, for example, in place of the destructible member 116). In such an embodiment, the valve may be activated (e.g., opened) so as to similarly allow fluid to be emitted from the atmospheric chamber, for example, in a metered or controlled fashion, as disclosed herein.

One or more embodiments of a well tool 200 and a system (e.g., system 10) comprising one or more of such well tools 200 having been disclosed, one or more embodiments of a wellbore servicing method utilizing the well tool 200 (and/or a system comprising such well tools) is disclosed herein. In an embodiment, such a method may generally comprise the steps of positioning a well tool 200 within a wellbore 14 that penetrates the subterranean formation, optionally, isolating adjacent zones of the subterranean formation, preparing the well tool for the communication of a servicing fluid via a pressure signal, and communicating a wellbore servicing fluid via the ports of the well tool 200. In an additional embodiment, (for example, where multiple well tools are placed within the wellbore) a wellbore servicing method may further comprise repeating the process of preparing the well tool for the communication of a servicing fluid via a pressure signal, and communicating a wellbore servicing fluid via the ports of the well tool 200 for each of the well tools 200. Further still, in an embodiment, a wellbore servicing method may further comprise producing a formation fluid from the well via the wellbore.

Referring to FIG. 1, in an embodiment the wellbore servicing method comprises positioning or "running in" a tubular string 12 comprising one or more of the multiple injection valves 16*a-e* (each of which, in the embodiment, disclosed herein, may comprise a well tool 200, as disclosed herein) with in the wellbore 14. For example, in the embodiment of FIG. 1, the tubular string 12 has incorporated therein a first valve 16*a*, a second valve 16*b*, a third valve 16*c*, a fourth valve 16*d*, and a fifth valve 16*e*. Also in the embodiment of FIG. 1, the tubular string 12 is positioned within the wellbore 14 such that the first valve 16*a* is proximate and/or substantially adjacent to the first earth formation zone 22*a*, the second valve 16*b* and the third valve 16*c* are proximate and/or substantially adjacent to the second zone 22*b*, the fourth valve 16*d* is proximate and/or substantially adjacent to the third zone 22*c*, and the fifth valve 16*e* is proximate and/or substantially adjacent to the fourth zone 22*d*. In alternative embodiments, one or more valves may be positioned proximate to a single zone; alternatively, a single valve may be positioned proximate to one or more zones. In an embodiment, for example, as shown in FIG. 1, injection valves 16*a*-16*e* (referenced also as the well tools 200) may be integrated within the tubular string 12, for example, such that, the well tools 200 and the tubular string 12 comprise a common flow passage. Thus, a fluid introduced into the tubular string 12 will be communicated via the well tool 200.

In the embodiment, the well tool 200 is introduced and/or positioned within a wellbore 14 in the first configuration, for example as shown in FIG. 14A. As disclosed herein, in the first configuration, the first sliding sleeve 110 is held in the first position, thereby retaining the activatable flapper valve 112 and allowing fluid communication in both directions via the flow passage 36 of the well tool 200. Additionally, in such an embodiment, the second sliding sleeve 111 is held in the first position by at least one shear pin 114 and the first sliding sleeve 110, thereby blocking fluid communication from the to/flow passage 30 of the well tool 200 to/from the exterior of the well tool 200 via the ports 28.

In an embodiment, once the tubular string 12 comprising the wellbore tool 200 (e.g., valves 16*a*-16*e*) has been positioned within the wellbore 114, one or more of the adjacent zones may be isolated and/or the tubular string 12 may be secured within the formation. For example, in the embodiment of FIG. 1, the first zone 22*a* may be isolated from relatively more uphole portions of the 14 (e.g., via the first packer 18*a*), the first zone 22*a* may be isolated from the second zone 22*b* (e.g., via the second packer 18*b*), the second zone 22*b* from the third zone 22*c* (e.g., via the third packer 18*c*), the third zone 22*c* from the fourth zone 22*d* (e.g., via the fourth packer 18*d*), the fourth zone 8 from relatively more downhole portions of the wellbore 14 (e.g., via the fifth packer 18*e*), or combinations thereof. In an embodiment, the adjacent zones may be separated by one or more suitable wellbore isolation devices. Suitable wellbore isolation devices are generally known to those of skill in the art and include but are not limited to packers (e.g., packers 18*a*-18*e*), such as mechanical packers and swellable packers (e.g., Swellpackers™, commercially available from Halliburton Energy Services, Inc.), sand plugs, sealant compositions such as cement, or combinations thereof. In an alternative embodiment, only a portion of the zones (e.g., 22*a*-22*e*) may be isolated, alternatively, the zones may remain unisolated. Additionally and/or alternatively, the tubular 12 may be secured within the formation, as noted above, for example, by cementing.

In an embodiment, the zones of the subterranean formation (e.g., one or more of zones 22*a*-22*e*) may be serviced working from the zone that is furthest down-hole (e.g., in the embodiment of FIG. 1, the fourth formation zone 22*d*) progressively upward toward the furthest up-hole zone (e.g., in the embodiment of FIG. 1, the first formation zone 22*a*).

In an embodiment where the wellbore is serviced working from the furthest-downhole formation zone progressively upward, once the tubular string 12 has been positioned and, optionally, once adjacent zones have been isolated, the fifth valve 16*e* (that is, a well tool 200, as disclosed herein) may be prepared for the communication of a servicing fluid to the proximate formation zone(s). In an embodiment, preparing the well tool 200 to communicate a servicing fluid may generally comprise communicating a pressure signal to the well tool 200 to transition the well tool 200 from the first configuration to the second configuration, and applying a hydraulic fluid pressure within the flow passage 36 of the well tool 200.

In an embodiment, the pressure signal 102 may be communicated to the well tool 200 to transition the well tool 200 from the first configuration to the second configuration, for example, by transitioning the first sliding sleeve from the first position to the second position. In an embodiment, the pressure signal 102 may be transmitted (e.g., from the surface) to the flow passage 36 of the well tool 200, for example, via the tubular string 12. In an embodiment, the pressure signal may be unique to a particular well tool 200. For example, a particular well tool 200 (e.g., the triggering system 106 of such a well tool) may be configured such that a particular pressure signal may elicit a given response from that particular well tool. For example, the pressure signal may be characterized as unique to a particular tool (e.g., one or more of valve 116*a*-116*e*). For example, a given pressure signal may cause a given tool to enter an active mode (e.g., to wake from a low power consumption mode), or to actuate the triggering system 106.

In an embodiment, the pressure signal may comprise known characteristics, known patterns, known sequences, and/or known combination thereof patterns, for example, as disclosed herein. The pressure signal may be sensed by the pressure sensor 40. In an embodiment, the pressure sensor 40 may communicate with the electronic circuit 42, for example, by transmitting a varying analog voltage signal via electrical wires, to determine whether the pressure sensor 40 has detected a predetermined signal (e.g., a pattern, a sequence, a combination of patterns, and/or any other characteristics of the pressure signal).

In an embodiment, communicating a pressure signal to the well tool 200 to transition the well tool 200 from the first configuration to the second configuration comprises communicating a first pressure signal (e.g., a first component 102*a* of a pressure signal), for example, to the well tool to cause the triggering system to "wake." In such an embodiment, communicating a pressure signal to the well tool 200 to transition the well tool 200 from the first configuration to the second configuration may further comprise communicating a second pressure signal (e.g., a second component 102*b* of a pressure signal), for example, to actuate the triggering system 106.

In an embodiment, in response to (e.g., upon) sensing the predetermined signal, the triggering system 106 may allow fluid to escape from the atmospheric chamber 116. In an embodiment, for example, following the detection of the predetermined pressure signal by the triggering system 106, the triggering system 106 may causing the atmospheric chamber to be opened. For example, in an embodiment, the pressure sensor 40 may detect the pressure within the flow passage 36 and communicate a signal indicative of that pressure (e.g., an electric or electronic signal) to the electric circuit 42. The electric circuit 42 may, utilizing the information obtained via the sensor 40, determine whether the pressure (e.g., the function of pressure with respect to time) experienced is a predetermined pressure signal. Upon recognition of the predetermined pressure signal, the electric circuit may communicate with the actuating member 45, (e.g., an electrically activated punch) thereby causing the actuating member to pierce, rupture, perforate, destroy, disintegrate, or the like, the destructible member 48 (e.g., a rupture disk). In such an embodiment, with the destructible member 48 ceasing to enclose the atmospheric chamber, the atmospheric chamber 116 may release the hydraulic fluid contained therein. As fluid escapes from the atmospheric chamber 116, the hydraulic fluid will no longer retain the first sliding sleeve 110 in its first position and the first sliding sleeve 110 will be free to move from the first position to the second position. For example, the first sliding sleeve may move from the first sliding sleeve 110 may move from the first position to the second position (e.g., downward) as a result of a fluid pressure applied to the flow passage 36 (e.g., because of a differential in the surface area of the upward-facing surfaces which are fluidicly exposed to the flow passage 36 and the surface area of the downward-facing surfaces which are fluidicly exposed to the flow passage 36).

In an embodiment as shown in FIG. 14B, as the first sliding sleeve 110 transitions from the first position to the second position, the first sliding sleeve 110 may cease to retain the flapper 112*a* of the activatable flapper valve 112 within he recessed chamber within the second sleeve 111. As such, the flapper 112*a* is free to rotate about the hinge 112*b* so as to protrude into the flow passage 36 of the well tool. For example, in an embodiment the flapper 112*a* may rotate about the hinge 112*b* onto a mating seat within the flow passage 36 of the well tool 200 and/or against the opposing walls of the second sliding sleeve 111. In such an embodiment, the flow passage 36 within the well tool 200 may become sealed, for example, during subsequent method steps, for example, by subsequent applications of pressure within the flow passage 36 and to the activatable flapper valve 112.

In an embodiment, the wellbore servicing method comprises applying a hydraulic pressure of at least a threshold value within flow passage 36 of the tubular string 12 and/or the well tool 200, for example, such that the second sliding sleeve is transitioned from the second configuration to the third configuration. For example, in an embodiment the application of hydraulic pressure may be effective to transition the second sliding sleeve 111 from the first position to the second position. For example, the hydraulic pressure may be applied to the flow passage 36 of the tubular string 12 and against the activatable flapper valve 112 of the second sleeve 111. In such an embodiment, the application of hydraulic pressure to the activatable flapper valve 112 of the second sleeve 111 may yield a force in the direction of the second position of the second sliding sleeve 111 (e.g., downward). In an embodiment, the hydraulic pressure may be of a magnitude sufficient to shear one or more shear pins 114, thereby causing the second sliding sleeve 111 to move relative to the housing 30, thereby transitioning from the first position to the second position and opening ports 28 to fluid flow.

In an embodiment, the pressure threshold may be selected and set (e.g., predetermined) via the number and/or rating of the shear pins 114. For example, the pressure threshold may be at least about 1,000 p.s.i., alternatively, at least about 2,000 p.s.i., alternatively, at least about 4,000 p.s.i., alternatively, at least about 6,000 p.s.i., alternatively, least about 8,000 p.s.i., alternatively, at least about 10,000 p.s.i., alternatively, at least about 12,000 p.s.i., alternatively, at least about 15,000 p.s.i., alternatively, at least about 18,000 p.s.i., alternatively, at least about 20,000 p.s.i., alternatively, any suitable pressure about equal or less than the pressure at which the tubular string 12 and/or the well tool 200 is rated.

In an embodiment, once the well tool 200 has been configured for the communication of a servicing fluid, for example, when the well tool (e.g., the fifth valve 16*e*) has transitioned to the third configuration, as disclosed herein and shown in FIG. 14C, a suitable wellbore servicing fluid may be communicated to the fourth earth formation zone 22*d* via the unblocked ports 28 of the fifth valve 16*e*. Nonlimiting examples of a suitable wellbore servicing fluid include but are not limited to a fracturing fluid, a perforating or hydrajetting fluid, an acidizing fluid, the like, or combinations thereof. The wellbore servicing fluid may be communicated at a suitable rate and pressure for a suitable duration. For example, the wellbore servicing fluid may be communicated at a rate and/or pressure sufficient to initiate or extend a fluid pathway (e.g., a perforation or fracture) within the subterranean formation 22 and/or a zone thereof.

In an embodiment, when a desired amount of the servicing fluid has been communicated to the fourth formation zone

22*d*, an operator may cease the communication of fluid to the fourth formation zone 22*d*. The process of preparing the well tool for the communication of a servicing fluid via communication of a pressure signal, and communicating a wellbore servicing fluid via the ports of the well tool 200 to the zone proximate to that well tool 200 may be repeated with respect to one or more of the relatively more-uphole well tools (e.g., the fourth, third, second, and first valves, 16*d*, 16*c*, 16*b*, and 16*a*, respectively, and the formation zones 22*c*, 22*b*, and 22*a*, associated therewith.

Additionally, following the completion of such formation stimulation operations, in an embodiment, the wellbore servicing method may further comprise producing a formation fluid (for example, a hydrocarbon, such as oil and/or gas) from the formation via the wellbore, for example, via the tubular string 12. In such an embodiment, the tubular string 12 may be utilized as a production string. For example, as such a formation fluid flows into the tubular 12, the formation fluid may flow upward via the tubular string 12, thereby opening the activatable flapper valve(s) 112 of each of the well tools (e.g., valve 16*a*-16*e*) incorporated therein.

In another additional embodiment, following the completion of such formation stimulation operation (for example, at some time after a servicing fluid has been communicated to a particular zone), the wellbore servicing method may further comprise removing the flapper valve 112 or a portion thereof. For example, in an embodiment where the flapper valve 112 (or a portion thereof) comprises a degradable material, removing the flapper valve 112 or a portion thereof may comprise contacting the flapper valve 112 with a fluid suitable to cause the degradable material to be degraded (e.g., dissolved, eroded, or the like). Additionally, in an embodiment removing the flapper 112 may comprise allowing the degradable material to be degraded or otherwise removed, applying a fluid pressure to the flapper valve 112 (e.g., an undegraded portion of the flapper valve 112), or otherwise encouraging the disintegration, dissolution, or structural failure of the flapper valve, for example, so as to allow fluid communication via the flow passage 36. In an embodiment, the degradable material may be configured to degrade (e.g., at least partially) during the performance of a servicing operation, for example, to dissolve, erode, or the like. For example, in an embodiment where the servicing fluid comprises an acid (e.g., an acid fracturing treatment), the presence of the acid may cause the degradation of at least a portion of the degradable material.

In an embodiment, a well tool such as well tool 200, a wellbore servicing system such as wellbore servicing system 10 comprising a well tool such as well tool 200, a wellbore servicing method employing such a wellbore servicing system 10 and/or such a well tool 200, or combinations thereof may be advantageously employed in the performance of a wellbore servicing operation. For example, conventional wellbore servicing tools have utilized ball seats, baffles, or similar structures configured to engage an obturating member (e.g., a ball or dart) in order to actuate such a servicing tool. In an embodiment, a well tool 200 may be characterized as having no reductions in diameter, alternatively, substantially no reductions in diameter, of a flowbore extending therethrough. For example, a well tool, such as well tool 200 may be characterized as having a flowbore (e.g., flow passage 36) having an internal diameter that, at no point, is substantially narrower than the flowbore of a tubing string (e.g., tubular string 12) in which that well tool 200 is incorporated; alternatively, a diameter, at no point, that is less than 95% of the diameter of the tubing string; alternatively, not less than 90% of the diameter; alternatively, not less than 85% of the diameter; alternatively, not less than 80% of the diameter. Additionally, such structures as conventionally employed to receive and/or engage an obturating member are subject to failure by erosion and/or degradation due to exposure to servicing fluids (e.g., proppant-laden, fracturing fluids) and, thus, may fail to operate as intended. In the embodiments disclosed herein, no such structure need be present. As such, the instantly disclosed well tools are not subject to failure due to the inoperability of such a structure. Further, the absence of such structure allows improved fluid flow through the well tools as disclosed herein, for example, because no such structures need be present to impede fluid flow.

Further, in an embodiment, the well tools as disclosed herein, may be actuated and utilized without the time delays necessary to actuate conventional well tool. For example, as will be appreciated by one of skill in the art upon viewing this disclosure, whereas conventional servicing tools utilizing ball seats, baffles, or similar structures to actuate such wellbore servicing tools, thereby necessitate substantial equipment and time to communicate balls, darts, or other similar signaling members to a given tool within the wellbore (e.g., so as to actuate such tool), the well tools disclosed herein, which may be actuated without the need to communicate any such signaling member, require significantly less time to perform similar wellbore servicing operations. As such, the instantly disclosed well tools may afford an operator substantial savings of both equipment and time (and the associated capital) while offering improved reliability.

It should be understood that the various embodiments previously described may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

ADDITIONAL DISCLOSURE

The following are nonlimiting, specific embodiments in accordance with the present disclosure:

A first embodiment, which is a wellbore servicing tool comprising:

a housing comprising one or more ports and a flow passage;

a triggering system;

a first sliding sleeve slidably positioned within the housing and transitional from a first position to a second position; and a second sliding sleeve slidably positioned within the housing and transitional from a first position to a second position;

wherein, when the first sliding sleeve is in the first position, the first sliding sleeve retains the second sliding sleeve in the first position and, when the first sliding sleeve is in the second position, the first sliding sleeve does not retain the second sliding sleeve in the first position, wherein, when the second sliding sleeve is in the first position, the second sliding sleeve prevents a route of fluid communication via the one or more ports of the housing and, when the second sliding sleeve is in the second position, the second sliding sleeve allows fluid communication via the one or more ports of the housing, and wherein the triggering system is configured to allow the first sliding sleeve to transition from the first position to the second position responsive to recognition of a predetermined signal, wherein the predetermined signal comprises a predetermined pressure signal, a predetermined temperature signal, a predetermined flow-rate signal, or combinations thereof.

A second embodiment, which is the wellbore servicing tool of the first embodiment, wherein the wellbore servicing tool further comprises a fluid chamber and configured such that, when a fluid is retained within the fluid chamber, the first sliding sleeve will be locked in the first position and, when the fluid is not retained within the fluid chamber, the first sliding sleeve will not be locked in the first position.

A third embodiment, which is the wellbore servicing tool of the second embodiment, wherein the triggering system is configured to selectively allow the fluid to escape from the fluid chamber.

A fourth embodiment, which is the wellbore servicing tool of the third embodiment, wherein the triggering system is configured such that, upon recognition of the predetermined signal, the fluid is allowed to escape from the fluid chamber.

A fifth embodiment, which is the wellbore servicing tool of one of the first through the fourth embodiments, wherein the triggering system comprises a pressure sensor, an electronic circuit, and an actuating member.

A sixth embodiment, which is the wellbore servicing tool of the fifth embodiment, wherein the electronic circuit comprises integrated control circuitry.

A seventh embodiment, which is the wellbore servicing tool of one of the fifth through the sixth embodiments, wherein the triggering system further comprises a battery.

An eighth embodiment, which is the wellbore servicing tool of one of the fifth through the seventh embodiments, wherein the electronic circuit is configured to recognize an electronic signal indicative of the predetermined signal.

A ninth embodiment, which is the wellbore servicing tool of the eighth embodiment, wherein the electronic signal comprises an electronic current.

A tenth embodiment, which is the wellbore servicing tool of one of the first through the ninth embodiments, wherein the actuating member comprises an activatable piercing mechanism.

An eleventh embodiment, which is the wellbore servicing tool of the tenth embodiment, wherein the piercing mechanism comprises a punch.

A twelfth embodiment, which is the wellbore servicing tool of the eleventh embodiment, wherein the wellbore servicing tool further comprises a destructible member configured to open the fluid chamber upon being pierced by the punch.

A thirteenth embodiment, which is the wellbore servicing tool of the twelfth embodiment, wherein the actuating member is configured, upon receipt of a signal, to pierce, rupture, destroy, perforate, disintegrate, combust, or combinations the destructible member.

A fourteenth embodiment, which is the wellbore servicing tool of one of the first through the thirteenth embodiments, wherein the second sliding sleeve further comprises a flapper valve, wherein the flapper valve is retained by the first sliding sleeve when the first sliding sleeve is in the first position, and wherein the flapper valve is not retained by the first sliding sleeve when the first sliding sleeve is in the second position.

A fifteenth embodiment, which is the wellbore servicing tool of the fourteenth embodiment, wherein the second sliding sleeve is configured to move from the first position to the second position upon the application of a force to the second sliding sleeve via the flapper valve.

A sixteenth embodiment, which is the wellbore servicing tool of one of the fourteenth through the fifteenth embodiments, wherein the flapper valve comprises a degradable material.

A seventeenth embodiment, which is the wellbore servicing tool of the sixteenth embodiment, wherein the degradable material comprises an acid soluble metal, a water soluble metal, a polymer, a soluble material, a dissolvable material, or combinations thereof.

An eighteenth embodiment, which is the wellbore servicing tool of one of the sixteenth through the seventeenth embodiments, wherein the degradable material is covered by a coating.

A nineteenth embodiment, which is the wellbore servicing tool of one of the first through the eighteenth embodiments, wherein the predetermined signal comprises the predetermined pressure signal.

A twentieth embodiment, which is a wellbore servicing method comprising:

positioning a wellbore servicing tool within a wellbore penetrating the subterranean formation, wherein the well tool comprises:

a housing comprising one or more ports and a flow passage;

a first sliding sleeve slidably positioned within the housing and transitional from a first position to a second position;

a second sliding sleeve slidably positioned within the housing and transitional from a first position to a second position; and a triggering system, wherein, when the first sliding sleeve is in the first position, the first sliding sleeve retains the second sliding sleeve in the first position and, when the first sliding sleeve is in the second position, the first sliding sleeve does not retain the second sliding sleeve in the first position, wherein, when the second sliding sleeve is in the first position, the second sliding sleeve prevents a route of fluid communication via the one or more ports of the housing and, when the second sliding sleeve is in the second position, the second sliding sleeve allows fluid communication via the one or more ports of the housing;

communicating a predetermined signal to the wellbore servicing tool, wherein the predetermined signal comprises a predetermined pressure signal, a predetermined temperature signal, a predetermined flow-rate signal, or combinations thereof, and wherein receipt of the predetermined signal by the triggering system allows the first sliding sleeve to transition from the first position to the second position;

applying a hydraulic pressure of at least a predetermined threshold to the wellbore servicing tool, wherein the application of the hydraulic pressure causes the second sliding sleeve to transition from the first position to the second position; and communicating a wellbore servicing fluid via the ports.

A twenty-first embodiment, which is the method of the twentieth embodiment, wherein the predetermined signal is uniquely associated with the wellbore servicing tool.

A twenty-second embodiment, which is the method of one of the twentieth through the twenty-first embodiments, wherein the predetermined signal comprises the predetermined pressure signal.

A twenty-third embodiment, which is the method of the twenty-second embodiment, wherein the predetermined pressure signal comprises a pulse telemetry signal.

A twenty-fourth embodiment, which is the method of the twenty-second embodiment, wherein the predetermined pressure signal comprises a discrete pressure threshold value.

A twenty-fifth embodiment, which is the method of the twenty-second embodiment, wherein the predetermined pressure signal comprises a series of discrete pressure threshold values over multiple time samples.

A twenty-sixth embodiment, which is the method of the twenty-second embodiment, wherein the predetermined pressure signal comprises a series of ramping pressures over time.

A twenty-seventh embodiment, which is the method of the twenty-second embodiment, wherein the predetermined pressure signal comprises a pulse width modulated signal.

A twenty-eighth embodiment, which is the method of one of the twentieth through the twenty-seventh embodiments, wherein the triggering system comprises a sensor, an electronic circuit, and an actuating member.

A twenty-ninth embodiment, which is the method of the twenty-eighth embodiment, wherein the triggering system is configured to recognize the predetermined signal.

A thirtieth embodiment, which is the method of one of the twentieth through the twenty-ninth embodiments, wherein upon recognition of the predetermined signal by the electronic circuit, the electronic circuit communicates a signal to the actuating member.

A thirty-first embodiment, which is the method of one of the twentieth through the thirtieth embodiments, wherein the second sliding sleeve further comprises a flapper valve, wherein the flapper valve is retained by the first sliding sleeve when the first sliding sleeve is in the first position, and wherein the flapper valve is not retained by the first sliding sleeve when the first sliding sleeve is in the second position.

A thirty-second embodiment, which is the method of the thirty-first embodiment, wherein the application of the hydraulic pressure applies a force to the second sliding sleeve via the flapper valve.

A thirty-third embodiment, which is the method of the thirty-first embodiment, further comprising causing the flapper valve to be removed.

A thirty-fourth embodiment, which is the method of the thirty-third embodiment, wherein causing the flapper valve to be removed comprises causing a degradable material within the flapper valve to be degraded.

A thirty-fifth embodiment, which is a wellbore servicing method comprising:

positioning a tubular sting having a wellbore servicing tool therein within a wellbore;

communicating a predetermined signal to the wellbore servicing tool, wherein the predetermined signal comprises a predetermined pressure signal, a predetermined temperature signal, a predetermined flow-rate signal, or combinations thereof;

applying a hydraulic fluid pressure to the wellbore servicing tool, wherein communicating the predetermined signal to the wellbore servicing tool, followed by the application of the hydraulic fluid pressure to the wellbore servicing tool, configures the tool for the communication of a wellbore servicing fluid to a proximate formation zone; and communicating the wellbore servicing fluid to the proximate formation zone.

A thirty-sixth embodiment, which is the wellbore servicing method of the thirty-fifth embodiment, wherein the predetermined signal is uniquely associated with the wellbore servicing tool.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A wellbore servicing tool comprising:

a housing comprising one or more ports and a flow passage;

a triggering system;

a first sliding sleeve slidably positioned within the housing and transitional from a first position of the first sliding sleeve to a second position of the first sliding sleeve; and a second sliding sleeve slidably positioned within the housing and transitional from a first position of the second sliding sleeve to a second position of the second sliding sleeve;

wherein the second sliding sleeve is movable relative to the first sliding sleeve;

wherein, when the first sliding sleeve is in the first position of the first sliding sleeve, the first sliding sleeve retains the second sliding sleeve in the first position of the second sliding sleeve and, when the first sliding sleeve is in the second position of the first sliding sleeve, the first sliding sleeve does not retain the second sliding sleeve in the first position of the second sliding sleeve, wherein, when the second sliding sleeve is in the first position of the second sliding sleeve, the second sliding sleeve prevents a route of fluid communication via the one or more ports of the housing and, when the second sliding sleeve is in the second position of the second sliding sleeve, the second sliding sleeve allows fluid communication via the one or more ports of the housing, and wherein the triggering system is configured to allow the first sliding sleeve to transition from the first position of the first sliding sleeve to the second position of the first sliding sleeve responsive to recognition of a predetermined signal.

2. The wellbore servicing tool of claim 1, wherein the wellbore servicing tool further comprises a fluid chamber and configured such that, when a fluid is retained within the fluid chamber, the first sliding sleeve will be locked in the first position of the first sliding sleeve and, when the fluid is not retained within the fluid chamber, the first sliding sleeve will not be locked in the first position of the first sliding sleeve.

3. The wellbore servicing tool of claim 2, wherein the triggering system is configured such that, upon recognition of the predetermined signal, the fluid is allowed to escape from the fluid chamber.

4. The wellbore servicing tool of claim 1, wherein the triggering system comprises a pressure sensor, an electronic circuit, and an actuating member.

5. The wellbore servicing tool of claim 4, wherein the electronic circuit is configured to recognize an electronic signal indicative of the predetermined signal.

6. The wellbore servicing tool of claim 1, wherein the actuating member comprises an activatable piercing mechanism.

7. The wellbore servicing tool of claim 6, wherein the piercing mechanism comprises a punch.

8. The wellbore servicing tool of claim 7, wherein the wellbore servicing tool further comprises a destructible member configured to open the fluid chamber upon being pierced by the punch.

9. The wellbore servicing tool of claim 8, wherein the actuating member is configured, upon receipt of the signal, to at least one of pierce the destructible member, rupture the destructible member, destroy the destructible member, perforate the destructible member, disintegrate the destructible member, combust the destructible member, or a combinations thereof.

10. The wellbore servicing tool of claim 1, wherein the second sliding sleeve further comprises a flapper valve, wherein the flapper valve is retained by the first sliding sleeve when the first sliding sleeve is in the first position of the first sliding sleeve, and wherein the flapper valve is not retained by the first sliding sleeve when the first sliding sleeve is in the the second position of the second sliding sleeve.

11. The wellbore servicing tool of claim 10, wherein the second sliding sleeve is configured to move from the first position of the second sliding sleeve to the second position of the second sliding sleeve upon the application of a force to the second sliding sleeve via the flapper valve.

12. The wellbore servicing tool of claim 10, wherein the flapper valve comprises a degradable material.

13. The wellbore servicing tool of claim 12, wherein the degradable material comprises an acid soluble metal, a water soluble metal, a polymer, a soluble material, a dissolvable material, or combinations thereof.

14. The wellbore servicing tool of claim 12, wherein the degradable material is covered by a coating.

15. The wellbore servicing tool of claim 1, wherein the predetermined signal comprises a predetermined pressure signal.

16. A wellbore servicing method comprising:

positioning a wellbore servicing tool within a wellbore penetrating the subterranean formation, wherein the wellbore servicing tool comprises:

a housing comprising one or more ports and a flow passage;

a first sliding sleeve slidably positioned within the housing and transitional from a first position of the first sliding sleeve to a second position of the first sliding sleeve;

a second sliding sleeve slidably positioned within the housing and transitional from a first position of the second sliding sleeve to a second position of the second sliding sleeve;

wherein the second sliding sleeve is movable relative to the first sliding sleeve; and a triggering system, wherein, when the first sliding sleeve is in the first position of the first sliding sleeve, the first sliding sleeve retains the second sliding sleeve in the first position of the second sliding sleeve and, when the first sliding sleeve is in the second position of the first sliding sleeve, the first sliding sleeve does not retain the second sliding sleeve in the first position of the second sliding sleeve, wherein, when the second sliding sleeve is in the first position of the second sleeve, the second sliding sleeve prevents a route of fluid communication via the one or more ports of the housing and, when the second sliding sleeve is in the second position of the second sliding sleeve, the second sliding sleeve allows fluid communication via the one or more ports of the housing;

communicating a predetermined signal to the wellbore servicing tool, wherein receipt of the predetermined signal by the triggering system allows the first sliding sleeve to transition from the first position of the first sliding sleeve to the second position of the first sliding sleeve;

applying a hydraulic pressure of at least a predetermined threshold to the wellbore servicing tool, wherein the application of the hydraulic pressure causes the second sliding sleeve to transition from the first position to the second position; and communicating a wellbore servicing fluid via the ports.

17. The method of claim 16, wherein a predetermined signal is uniquely associated with the wellbore servicing tool.

18. The method of claim 16, wherein the predetermined signal comprises the predetermined pressure signal.

19. The method of claim 18, wherein the predetermined pressure signal comprises a pulse telemetry signal, a discrete pressure threshold value, a series of discrete pressure threshold values over multiple time samples, a series of ramping pressures over time, a pulse width modulated signal, or combinations thereof.

20. The method of claim 16, wherein the triggering system is configured to recognize the predetermined signal.

21. The method of claim 16, wherein upon recognition of the predetermined signal by an electronic circuit00, the electronic circuit communicates a signal to the actuating member.

22. The method of claim 16, wherein the second sliding sleeve further comprises a flapper valve, wherein the flapper valve is retained by the first sliding sleeve when the first sliding sleeve is in the first position of the first sliding sleeve, and wherein the flapper valve is not retained by the first sliding sleeve when the first sliding sleeve is in the second position of the first sliding sleeve.

23. The method of claim 22, wherein the application of the hydraulic pressure applies a force to the second sliding sleeve via the flapper valve.

24. The method of claim 22, further comprising causing the flapper valve to be removed.

25. The method of claim 24, wherein causing the flapper valve to be removed comprises causing a degradable material within the flapper valve to be degraded.

* * * * *